US010738603B2

(12) United States Patent
Heller

(10) Patent No.: US 10,738,603 B2
(45) Date of Patent: Aug. 11, 2020

(54) WATER SAMPLING ASSEMBLY AND METHOD FOR GROUNDWATER PRODUCTION WELLS AND BOREHOLES

(71) Applicant: BESST, INC., San Rafael, CA (US)

(72) Inventor: Noah R. Heller, Corte Madera, CA (US)

(73) Assignee: BESST, Inc., San Rafael, CA (US)

( * ) Notice: Subject to any disclaimer, the term of this patent is extended or adjusted under 35 U.S.C. 154(b) by 198 days.

(21) Appl. No.: 15/437,898

(22) Filed: Feb. 21, 2017

(65) Prior Publication Data

US 2017/0241263 A1 Aug. 24, 2017

Related U.S. Application Data

(60) Provisional application No. 62/298,197, filed on Feb. 22, 2016.

(51) Int. Cl.
*E21B 49/08* (2006.01)
*E03B 3/08* (2006.01)
*E03B 3/15* (2006.01)

(52) U.S. Cl.
CPC ..... *E21B 49/084* (2013.01); *E03B 3/08* (2013.01); *E03B 3/15* (2013.01)

(58) Field of Classification Search
CPC ..... E21B 49/08; E21B 49/084; E21B 49/081; E21B 49/082; E21B 49/083; E21B 49/085; E21B 49/086; E21B 49/087; E03B 3/15; E03B 3/08
See application file for complete search history.

(56) References Cited

U.S. PATENT DOCUMENTS 4,538,683 A * 9/1985 Chulick ..... E21B 49/084 166/191
4,838,079 A * 6/1989 Harris ..... E21B 17/18 166/127
6,131,451 A 10/2000 Izbicki et al.
6,164,127 A * 12/2000 Izbicki ..... E21B 47/1015 73/152.23
6,865,933 B1 * 3/2005 Einarson ..... E21B 33/122 166/264
8,424,377 B2 * 4/2013 Keller ..... E21B 47/042 73/152.28

(Continued)

*Primary Examiner* — Robert E Fuller
*Assistant Examiner* — Theodore N Yao
(74) *Attorney, Agent, or Firm* — Roeder & Broder LLP; James P. Broder

(57) ABSTRACT

A water sampling assembly for sampling water within a groundwater production well includes a primary pump and a water sampler. The primary pump is positioned within the groundwater production well. Additionally, the primary pump defines at least a portion of an annulus between the primary pump and one of the support casing and the well screen. The water sampler is configured to obtain a plurality of water samples from the groundwater production well without removal of the water sampler from the groundwater production well. Additionally, the water sampling assembly can further include a flow detection assembly that is conjoined with the water sampler within a single jacket to form a conjoined system. The flow detection assembly is configured to detect a flow, i.e. a dynamic flow and/or an ambient flow, of the water within the groundwater production well.

24 Claims, 21 Drawing Sheets

(56) References Cited

U.S. PATENT DOCUMENTS

2013/0333881 A1* 12/2013 Heller ..... E03B 3/08
166/250.15
2016/0047225 A1* 2/2016 Keller ..... E21B 49/08
73/152.28

* cited by examiner

WATER SAMPLING ASSEMBLY AND METHOD FOR GROUNDWATER PRODUCTION WELLS AND BOREHOLES

RELATED APPLICATION

This application claims priority on U.S. Provisional Application Ser. No. 62/298,197, filed on Feb. 22, 2016 and entitled "WATER SAMPLING ASSEMBLY AND METHOD FOR GROUNDWATER PRODUCTION WELLS". As far as permitted, the contents of U.S. Provisional Application Ser. No. 62/298,197 are incorporated herein by reference.

BACKGROUND

A groundwater production well (also sometimes referred to herein as a "groundwater well", a "production well", or simply as a "well") is a structure where groundwater is produced for consumption by people, animal livestock, agricultural purposes as well as industrial purposes (such as refining, mining, landfills, technology and so forth). Groundwater production wells can also include test holes for groundwater exploration. These wells consist of a support casing and well screen—through which groundwater enters the well. These wells may also be constructed in bedrock and serve the same purpose. There is also a primary pump inside the well, typically consisting of a line shaft turbine or electric submersible pump that is positioned at depth inside the well. The depth set location of the pump is derived from many factors that come into play such as 1) depth to water, 2) pumping water level, 3) rate of declining water table, 4) rate of recharge to the aquifer, 5) the depth of the target zones to be pumped on by the primary pump, and 6) the storage and transmissivity of the aquifer itself. Typically, the pump diameters are large relative to the size of the support casing and well screen as well as the pump column that extends between the pump and the ground surface. Moreover, each section of pump column is connected by means of a larger diameter threaded collar. Therefore, the pump column consists of ten to twenty foot sections of pipe of a smaller diameter but terminated on each end by a collar that is at least one-half inch to one inch larger than the main section of the pipe itself.

Global warming combined with increasing population has placed a larger demand on groundwater resources worldwide. As such, existing primary pumps in municipal, agricultural and industrial wells with long vertical and segmented sections of perforations, are periodically lowered to deeper pump intake locations inside the well as water tables around the world continue to deepen due to over-pumping of groundwater supplies combined with protracted drought. If the water level inside the well drops too much, the pump begins to cavitate (sucking in a combination of air and water). Therefore, it can be desired to lower the pump to a more favorable depth location in order to prevent production disruptions.

Conventional flow, chemistry and other types of sensor based down-hole measurement technologies, as well as down-hole groundwater sampling technologies that are used to collect samples for analysis and field based chemical analysis, are most often too large to collect this data within the annulus between the primary pump and the support casing and/or the well screen. Thus, the primary pump typically needs to be removed before any such technologies can be moved into the well.

Additionally, in situations where the well is not straight as it extends downward, existing conventional technologies require modifications in order to be centered inside the production well along the central axis. Then, a standard correction factor must be applied to convert the centralized measurements to an estimate of the average bulk flow rate—essentially a statistical extrapolation for measuring the cumulative flow through the cross-sectional area of the well (through any depth-defined imaginary horizontal plane that is perpendicular to the length of the well). Therefore, placement of the conventional technologies requires first removing the existing pump assembly from the well so that they can be inserted into the wells; with large protruding centralizers surrounding the tool. The centralizers keep the tool centered through the well during the entire profiling survey.

While some currently available systems do include water samplers and/or flow detection technologies that can be small enough to pass the pump through the annular space in many instances, such technologies still require multiple trips into and out of the well to obtain the water samples and corresponding flow rates at the desired depths. For example, for each water sample collected, the water sampler must be removed from the well for sample retrieval, then decontaminated at the ground surface, and then followed by reinstallation back into the well and lowered to the next sampling depth. Each time the water sampler is lowered into the well, the mechanical or optical counter that is used must be reset in order to track the vertical descent distance to the next sampling location. As the water sampler moves into and out of the well, water, oil, bio-slime, rust slime and so forth build up on the outside of the water sampler, causing the water sampler to slip over the roller of the various types of counters. In doing so, sampling depth errors may then occur which can create offsets and errors in the data. Some of the errors can be significant and can misdirect the science team and others involved in the decision-making process as to where contaminants are entering the well. Such misdirected decisions may then lead to incorrectly applied rehabilitation procedures, such as setting of inflatable packers and expandable sleeves at the wrong depth, thereby blocking good water from coming into the well as opposed to the bad water quality the producer is trying to avoid. Moreover, there is risk and legal liabilities associated with misplacement of packers, sleeves, engineered suctions and pump depths since incorrect placement of these well modifying structures can be costly and time-consuming. These types of errors can lead to contract disputes, liquidated damages, ill will and loss of reputation for the service providers who profile and modify these wells.

Further, current systems further require additional trip(s) into and out of the well for purposes of detecting flow of the water within the well at any desired depths. For example, in current systems, multiple trips into the well are required with the multiple trips including at least once for the flow detection technologies, and then followed by multiple times for a single tube bailer to sample multiple depths.

Additionally, in recent years, various technologies have been previously employed for purposes of detecting flow of the groundwater within the groundwater production well. Unfortunately, such technologies all have experienced certain limitations when it comes to accurately detecting the ambient flow (i.e. the non-pumping flow) of the groundwater within the well. For example, most conventional devices for purposes of detecting the ambient flow of the groundwater within the well are simply too large to easily fit down into the well with the pump assembly positioned therein. Additionally, such conventional devices also require multiple trips into and out of the well, as water sampling and flow detection are typically conducted separately and at only a single depth per trip. As noted above, such issues can lead to problems in terms of accuracy, as well as causing time-related and cost-related problems. Moreover, due to the size of these components in existing systems, any thought of conjoining such technologies or integration of their electronics would also be problematic.

Thus, it is desired to develop water sampling assemblies that are configured to overcome the drawbacks experienced by currently available technologies.

SUMMARY

The present invention is directed toward a water sampling assembly for sampling water within a groundwater production well, the groundwater production well including a support casing and a well screen that are positioned below a surface. In various embodiments, the water sampling assembly includes a primary pump and a water sampler. The primary pump is positioned within the groundwater production well. Additionally, the primary pump defines at least a portion of an annulus between the primary pump and one of the support casing and the well screen. The water sampler is configured to obtain or collect a plurality of water samples from the groundwater production well without removing the water sampler from the well between sampling events, i.e. with a single trip of the water sampler into and out of the groundwater production well.

In some embodiments, the water sampler is a multilevel bailer including a plurality of sampling tubes and a plurality of tube valves, with one tube valve being associated with each of the plurality of sampling tubes. In some such embodiments, one of the plurality of water samples can be obtained with each of the plurality of sampling tubes. Additionally, each of the plurality of water samples can be obtained from a different depth within the groundwater production well. Further, in certain embodiments, all of the plurality of sampling tubes are conjoined together within a single jacket such as to form a single sampling unit.

Alternatively, in other embodiments, the water sampler is a miniaturized sampling pump including a pump body, a gas supply line that provides compressed gas to the pump body, and a return line that transmits each of the plurality of water samples toward the surface.

In many embodiments, the water sampling assembly further includes a flow detection assembly that is conjoined with the water sampler within a single jacket to form a conjoined system. In such embodiments, the flow detection assembly is configured to detect a flow of the water within the groundwater production well. In some embodiments, the plurality of water samples are obtained from multiple depths within the groundwater production well. Additionally, in such embodiments, the flow detection assembly is configured to detect the flow of the water within the groundwater production well at each of the multiple depths within the groundwater production well.

In alternative applications of the present invention, the conjoined system can be inserted into the groundwater production well through the annulus, or the groundwater production well can further include an access pipe that extends below the level of the primary pump, and the conjoined system can be inserted into the groundwater production well through the access pipe.

In various embodiments, the flow detection assembly includes a tracer injection tube that retains a tracer material, and an injection valve that regulates the injection of the tracer material from the tracer injection tube into the groundwater production well. The flow detection assembly can further include a tracer detector that is positioned at a different depth than the injection valve within the groundwater production well, the tracer detector being configured to detect the presence of the tracer material in the water within the groundwater production well.

Additionally and/or alternatively, the flow detection assembly can further include a first laser emitter that is positioned at a different depth than the injection valve within the groundwater production well to detect a flow of the water within the groundwater production well. The first laser emitter can be positioned above the tracer injection tube within the groundwater production well, or the first laser emitter can be positioned below the tracer injection tube within the groundwater production well. In some embodiments, the flow detection assembly further includes a second laser emitter, wherein the first laser emitter is positioned above the injection valve within the groundwater production well and the second laser emitter is positioned below the injection valve within the groundwater production well.

In certain applications, the tracer material is injected into the groundwater production well with the primary pump turned on such that the flow detection assembly is configured to detect a dynamic flow of the water within the groundwater production well. Additionally, in other applications, the tracer material is injected into the groundwater production well with the primary pump turned off such that the flow detection assembly is configured to detect an ambient flow of the water within the groundwater production well.

In some embodiments, the flow detection assembly includes a plurality of tracer injection tubes that each retain the tracer material, each tracer injection tube including a corresponding injection valve that regulates the injection of the tracer material from the tracer injection tube into the groundwater production well.

The present invention is further directed toward a method for sampling water within a groundwater production well, the groundwater production well including a support casing and a well screen that are positioned below a surface, the method including the steps of (i) positioning a primary pump within the groundwater production well, the primary pump defining at least a portion of an annulus between the primary pump and one of the support casing and the well screen; and (ii) collecting a plurality of water samples from the groundwater production well with a water sampler without removing the water sampler from the groundwater production well. The method can further include the steps of conjoining a flow detection assembly with the water sampler within a single jacket to form a conjoined system; and detecting a flow of the water within the groundwater production well with the flow detection assembly.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a water sampling assembly and method for improving the ability to recognize volatile organic contaminants and inorganic contaminants from inside groundwater production wells. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same or similar nomenclature and/or reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1A:
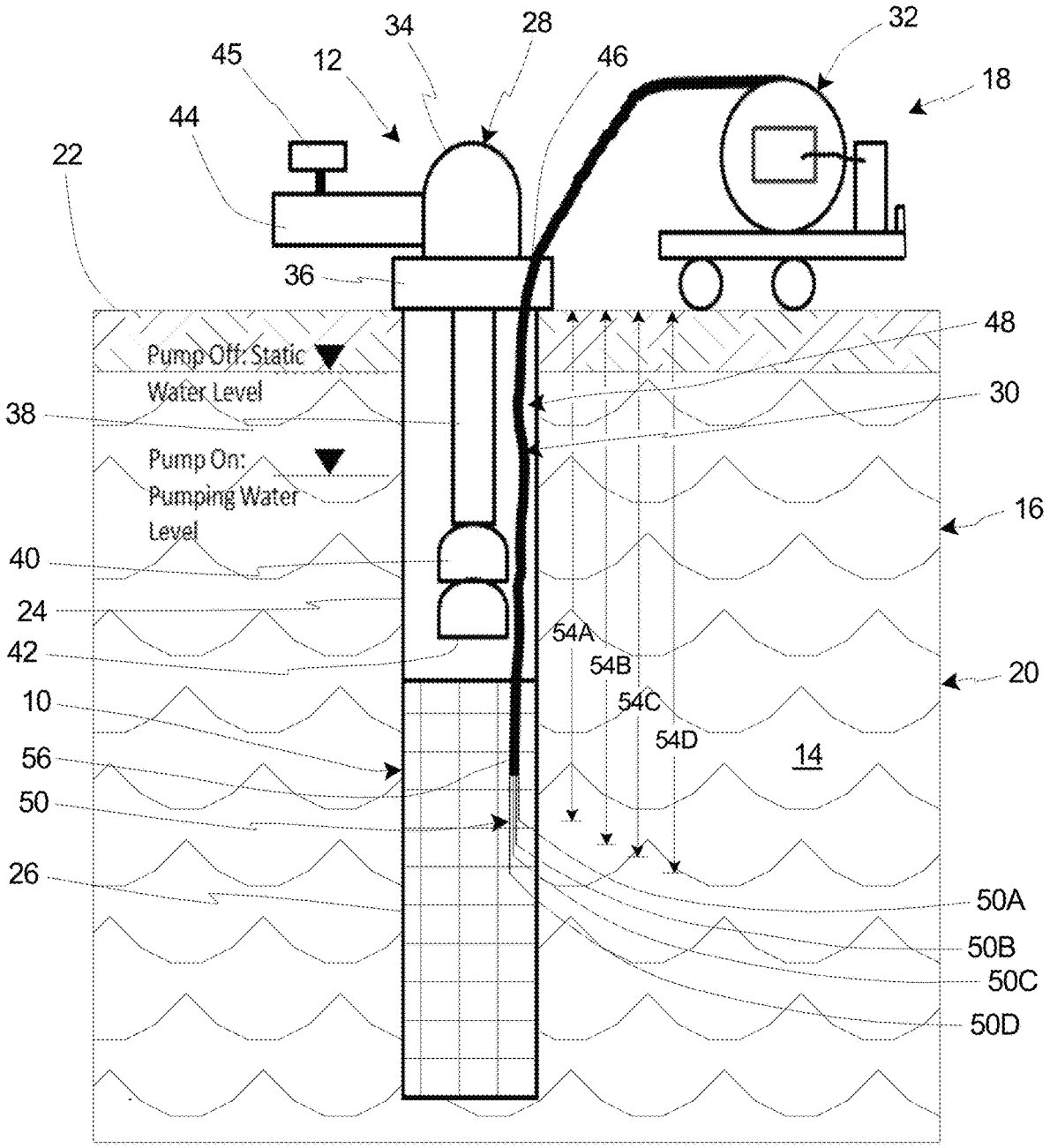
FIG. 1A is a simplified schematic illustration of a groundwater production well and an embodiment of a water sampling assembly having features of the present invention that is positioned at least partially within the groundwater production well, the water sampling assembly including a water sampler.

First Embodiment—Miniaturized, Flexible Multilevel Bailer for Use Inside Pumping and Non-Pumping Production Wells and Uncased Boreholes FIG. 1A is a simplified schematic illustration of a groundwater production well 10 (also referred to herein as a "groundwater well", a "production well", or simply as a "well"), and an embodiment of a water sampling assembly 12 having features of the present invention that is positioned at least partially within the groundwater production well 10. As illustrated, the groundwater production well 10 provides access to one or more fluids, e.g., groundwater 14, that are present within a subsurface environment 16. It is also understood that as used herein, the term "well" or "groundwater well" is also intended to include partially cased or uncased boreholes.

It is appreciated that although the description provided herein is primarily focused on access to and sampling of groundwater 14, the present invention can also be applied for purposes of accessing and sampling other types of fluids.

The groundwater well 10 can be installed using any one of a number of methods known to those skilled in the art. In non-exclusive, alternative examples, the groundwater well 10 can be installed with hollow stem auger, sonic, air rotary casing hammer, dual wall percussion, dual tube, rotary drilling, vibratory direct push, cone penetrometer, cryogenic, ultrasonic and laser methods, or any other suitable method known to those skilled in the art of drilling and/or well placement.

As illustrated, the groundwater well 10 can be said to include a surface region 18 and a subsurface region 20. The surface region 18 is an area that includes the top of the groundwater well 10 which extends to and/or is positioned above a surface 22. The surface 22 can either be a ground surface or the surface of a body of water or other liquid, as non-exclusive examples. The subsurface region 20 is the portion of the groundwater well 10 that is below the surface 22 and below the surface region 18, e.g., at a greater depth than the surface region 18.

Additionally, as illustrated, the groundwater well 10 includes a support casing 24 and a well screen 26. The support casing 24 can be a hollow, generally cylinder-shaped structure that extends in a generally downward direction into the subsurface region 20 to help provide access to the groundwater 14, and/or other fluids and materials present within the subsurface region 20. The support casing 24 can have any desired thickness and can be formed from materials such as polyvinylchloride (PVC), other plastics, fiberglass, ceramics, metal, or other suitable materials. Additionally, the length of the support casing 24 can be varied to suit the specific design requirements of the groundwater well 10 and/or depending on the specific locations of the desired groundwater 14, and/or other fluids and materials within the subsurface environment 16. Further, an inner diameter of the support casing 24 can vary depending upon the specific design requirements of the groundwater well 10 and/or the water sampling assembly 12. It is understood that although the support casing 24 is illustrated in the Figures as being positioned substantially vertically, the support casing 24 and the other structures of the groundwater well 10 can alternatively be positioned at any suitable angle relative to vertical.

The well screen 26 extends from and/or forms a portion of the support casing 24 within the subsurface environment 16. The well screen 26 can comprise a perforated pipe that provides an access means through which the groundwater 14 enters the well 10. As illustrated, the well screen 26 is adapted to be positioned at a level within the subsurface environment 16 in vertical alignment with and/or substantially adjacent to the groundwater 14 within the subsurface region 20. It is noted that although the well screen 26 is shown as extending in a substantially continuous manner adjacent to the groundwater 14 within the subsurface region 20; the well screen 26 can alternatively be positioned in a more discretized manner, such that the well screen 26 is provided in a number of individual sections that are positioned only in vertical alignment with and/or substantially adjacent to certain portions of the groundwater 14.

It is understood that the water sampling assembly 12 described herein can also be applied to uncased boreholes where fluids are produced directly into the borehole from surrounding fractured bedrock materials.

The design of the water sampling assembly 12 can be varied depending on the specific requirements and characteristics of the groundwater production well 10, and/or depending on the specific availability of the groundwater 14 within the subsurface environment 16. In various embodiments, as shown in FIG. 1A, the water sampling assembly 12 includes a primary pump assembly 28 (also referred to herein as the "primary pump" or simply the "pump"), a water sampler 30, and a control system 32. As provided herein, in various embodiments, it is desired to be able to install the water sampler 30 into the well 10 and past or below the primary pump 28 without removing the primary pump 28 from the well 10, and/or with the primary pump 28 positioned at least partially therein. Another characteristic of the water sampling assembly 12 is that in certain embodiments it is small enough to test the well 10 above the primary pump 28, between a support column that suspends the primary pump 28 inside the well 10 or borehole and the surrounding well perforations or fractured bedrock materials.

Additionally and/or alternatively, the water sampling assembly 12 can include more components or fewer components than those specifically illustrated and described in relation to FIG. 1A. For example, in certain non-exclusive alternative embodiments, the water sampling assembly 12 can further include a flow detection assembly that operates to detect the flow of the groundwater 14, i.e. either or both of the dynamic flow (pump on) and ambient flow (pump off) of the groundwater 14, within the subsurface environment 16, and/or a miniaturized sampling pump that operates to assist in collection of groundwater samples within the subsurface environment 16.

As provided herein, the described invention, i.e. the water sampling assembly 12, is focused on significant improvements to the water sampling process for accurately identifying and locating the source of volatile organic contaminants as well as inorganic contaminants from inside groundwater production wells. For purposes of water sampling, the water sampler 30 is utilized as a means to remove water samples from the well 10. Once removed, the water samples can then be tested to determine and/or define the level of any contaminants that may be present within the particular water samples. More specifically, in some embodiments, the water samples can then be tested to determine and/or define the hydrogeochemical stratification of naturally occurring dissolved aqueous phase trace elements and minerals as well as anthropogenic contaminants (i.e. nitrate, perchlorate, organics, etc.).

The primary pump 28 provides a means to selectively remove the groundwater 14 from the groundwater well 10. As illustrated, the primary pump 28 can include a pump head 34, a pump support plate 36 (also sometimes referred to herein as a "support plate"), a pump column 38, one or more impeller pump bowls 40 (also referred to herein simply as "pump bowls"), and a pump intake 42. Additionally, the primary pump 28 can further include pump collars (not shown) that connect different sections of the pump column 38 to one another. Alternatively, the primary pump 28 can have a different design. For example, the primary pump 28 can be designed with greater or fewer elements than those specifically illustrated in FIG. 1A.

In this embodiment, the pump head 34 is positioned above the surface 22 and houses a pump motor (not illustrated) and a portion of a discharge pipe 44 (a portion of the discharge pipe 44 is illustrated extending to the left in FIG. 1A away from the pump head 34). As taught in various applications of the present invention, the pump motor selectively activates the primary pump 28 such that the level of the groundwater 14 can be adjusted within the subsurface region 20. Additionally, as illustrated, a flow meter 45 can be coupled to the discharge pipe 44, which can be used to regulate and/or measure the volume of flow of the groundwater 14 that is moved through and out of the discharge pipe 44, e.g., into a groundwater distribution system (not shown) or into a waste water system (not shown).

The support plate 36 supports the pump head 34. Additionally, the support plate 36 can further support other portions of the primary pump 28 that are coupled to the pump head 34. As illustrated, in one embodiment, the support plate 36 can be positioned substantially adjacent to the surface 22 and can support the pump head 34 above the surface 22. Additionally, as described in greater detail herein below, in certain embodiments, the support plate 36 can provide an access port 46 for the water sampler 30 to be inserted into the groundwater well 10 past the primary pump 28.

It may be desired to have different possibilities within the water sampling assembly 12 as to what can function as the access port 46 to enable the water sampler 30 to be inserted into the groundwater well 10 and positioned below the primary pump 28. For example, in certain non-exclusive alternative embodiments, the access port 46 can be provided by a support aperture, e.g., a vent pipe, a bolt hole and/or a drilled hole that extends through the support plate 36; a water level measurement port, which typically provides access for a transducer that can be used to measure the fluid level within the well 10; and/or a camera tube, which typically provides a means for visually observing, e.g., with a camera, what is going on within the well 10. Alternatively, the access port 46 can be provided in a different manner than described herein.

The pump column 38 is coupled to the pump head 34 and extends in a generally downward direction away from the pump head 34 into the subsurface region 20 of the groundwater well 10. The pump column 38 can be of any desired length depending on the specific requirements of the groundwater well 10 and/or the location of the groundwater 14 within the well 10.

As illustrated, the pump bowls 40 can be positioned at, near and/or adjacent to the end of the pump column 36 away from the pump head 34. Additionally, as shown, the pump bowls 40 can have the largest diameter of any portion of the primary pump 28 that is positioned within the subsurface region 20. Typically, the largest diameter of the primary pump 28 within the subsurface region 20 is fairly large relative to the size of the support casing 24 and the well screen 26, such that there is relatively small spacing, or annulus 48, between the primary pump 28 and the support casing 24 and/or the well screen 26.

In the embodiment illustrated in FIG. 1A, the pump intake 42 is an opening for the groundwater 14 to enter the pump column 38 and thereafter be transported to the surface 22 where the groundwater 14 can be removed via the discharge pipe 44. In one embodiment, the pump intake 42 can be positioned substantially adjacent to the pump bowls 40. Alternatively, the pump intake 42 can be positioned at a different location within the groundwater well 10, i.e. away from the pump bowls 40.

The depth set location of the pump intake 42 is derived from many factors that come into play such as 1) the depth of the groundwater 14 within the subsurface region 20, 2) the pumping fluid level, 3) the rate of declining water table within the subsurface region 20, 4) the rate of recharge of the groundwater 14 within the subsurface region 20, 5) the depth of the target zones from which the groundwater 14 is to be sampled, and/or 6) the storage and transmissivity of the groundwater 14 within the subsurface region 20.

As provided herein, the water sampler 30 can be configured to overcome many of the drawbacks that exist in current systems. For example, in various embodiments, the water sampler 30 can provide significant improvements in the areas of accuracy, time-efficiency and cost-efficiency for the water sampling assembly 12 in comparison to existing systems. In some embodiments, to better achieve the desired time-efficiency and cost-efficiency goals, it can be desired to install the water sampler 30 via the annulus 48 into the well 10 and past the primary pump 28 without removing the primary pump 28 from the well 10 and/or with the primary pump 28 positioned at least partially therein. Additionally or alternatively, in certain non-exclusive alternative embodiments, e.g., when the annulus 48 is too small to enable proper or reliable insertion of the water sampler 30 into the groundwater well 10 and past the primary pump 28, an access pipe (not shown in FIG. 1A) can be installed that extends from the surface to some distance past the pump intake 42 at depth. In such embodiments, the water sampler 30 can be installed into the groundwater well 10 and past the primary pump 28 via the access pipe.

Further, anticipating continuing water table decline into the foreseeable future, groundwater producers wish to minimize the number of times that the primary pump 28 must be lowered throughout the life cycle of the groundwater well 10 in order to minimize pump service costs, potential damage to the groundwater well 10 and the primary pump 28 from scraping during movement, and, moreover, disruption of service. Therefore, the primary pump 28 must be lowered deep enough to avoid these problems from recurring too frequently. Consequently, when compensating for future water level declines by over-deepening the pump intake 42 location, there are typically sections of well screen 26 above the pump intake 42 that will still produce water.

Additionally, if flow, chemistry and other types of data are required from above the pump intake 42 and within the sections of well screen 26 that are still producing, miniaturized technologies are necessary to access the annulus 48 between the primary pump 28 and the support casing 24, and/or between the primary pump 28 and the well screen 26. In particular, advances in miniaturization of groundwater flow, water sampling and sensor technologies now make it possible to access many of these wells through the annulus 48 without removal of the primary pump 28. As noted above, the annulus 48 is the space between the pump column 38 and support casing 24 and well screen 26, between the pump collars and support casing 24 and well screen 26, and/or between the primary pump assembly 28 and the support casing 24 and well screen 26. As an example, a twelve-inch primary pump assembly can be placed inside of a sixteen-inch support casing and/or well screen. If the primary pump assembly is perfectly centered inside the well, there would be a two-inch annulus all the way around the outside of the primary pump assembly. Being that wells are rarely straight, the primary pump assembly and pump column commonly veers to one side of the well with increasing depth such that the annulus is very small on one side of the pump and larger on the other side. Even still, there are many cases in which these new miniaturized technologies can pass by the pump and into the section of well below the pump intake e.g., provided that they pass by the pump on the side with the larger annular space.

As noted above, making multiple trips into and out of the groundwater production well can create adverse issues with the counter. This can result in offsets and errors in the data, which can further cause and/or require costly and time-consuming remediation efforts.

Another key concern in making multiple trips into and out of a groundwater production well is that with more round trips of the water sampler, there is an increased probability that the water sampler may become stuck at some point inside the well. Fluid turbulence is the norm inside pumping wells and turbulent patterns can shift over time due to small changes in the pumping rate. As such, a water sampler can be moved circumferentially inside the well by the turbulent water to a pinch point between the pump collar and support casing or between the pump and the support casing, rendering the water sampler useless and bringing the project to a stopping point. Most often, the primary pump has to then be lifted and sometimes even removed in order to free up the water sampler from inside the well. There is also vibration of the pump column and pump motor that can cause small spatial shifts in the available free annulus that may contribute to the water sampler becoming stuck. The cost of freeing up the water sampler when lifting or removing the pump is significant and may also lead to contract disputes, liquidated damages, ill will and loss of reputation to the various service providers.

Lastly, the more round trips for water sampler entry and egress from the well, the longer the project will take, thereby resulting in increased costs. Since the water sampler is being operated under pumping conditions and with the primary pump, the well owner/operator must either pump the groundwater into a distribution system or to a permitted waste stream. In the situation where the pumping well is being tested for water quality, and the target contaminants present in the well exceed regulated maximum contaminant levels (MCLs), the groundwater produced from the well must be pumped to waste provided that the operator holds a special permit allowing discharge to the waste water system. Commonly, discharge to the waste water stream is regulated in such a way that only a specific volume of water can be produced on a daily or even hourly basis. Therefore, multiple trips in and out of a well will consume more available time for any discharge rate from the well. If numerous samples are required, then the project cost must factor in multiple days of field work to collect all of the water samples.

Thus, as provided herein, the water sampling assembly 12 of the present invention includes the water sampler 30 which is uniquely configured to provide the various and significant improvements in accuracy, time-efficiency and cost-efficiency. For example, the new technology incorporated within the water sampler 30 minimizes and/or eliminates the counter error problems described above for previous systems by minimizing the number of trips for the water sampler 30 into and out of the groundwater production well 10. Further, minimizing the number of trips for the water sampler 30 into and out of the well 10 also provides advantages in terms of time and cost for the project as a whole.

In particular, in the embodiment illustrated in FIG. 1A, the water sampler 30 consists of a miniaturized multi-tube, multi-valve (and multilevel) bailer that can be lowered to multiple sampling depths, with each tube of the miniaturized multilevel bailer being assigned to a different sampling depth. More specifically, and as shown in greater detail in FIG. 1B, which is an enlarged view of a portion of the water sampler 30 illustrated in FIG. 1A, the water sampler 30 includes a plurality of sampling tubes 50 (also sometimes referred to herein simply as "tubes") and a plurality of tube valves 52. Access to each of the sampling tubes 50 for the groundwater 14 within the well 10 is regulated by one or more of the plurality of tube valves 52 (e.g., check valves).

As an example, if the sampling project from the groundwater well 10 requires eight sampling events, and the multilevel bailer 30 consists of eight individual sampling tubes 50 and corresponding check valves 52 located at the bottom 51 of each sampling tube 50, then all of the samples from the different depths inside the well 10 can be collected with a single trip into and out of the well 10, i.e. without removing the multilevel bailer 30 from the well 10 between sampling events. Moreover, with a limited number of trips being required into and out of the well 10, the multi-tube, multi-valve bailer 30 minimizes the chance for getting stuck inside the well 10, and significantly minimizes the field time for the project and the associated costs.

Figure 1B:
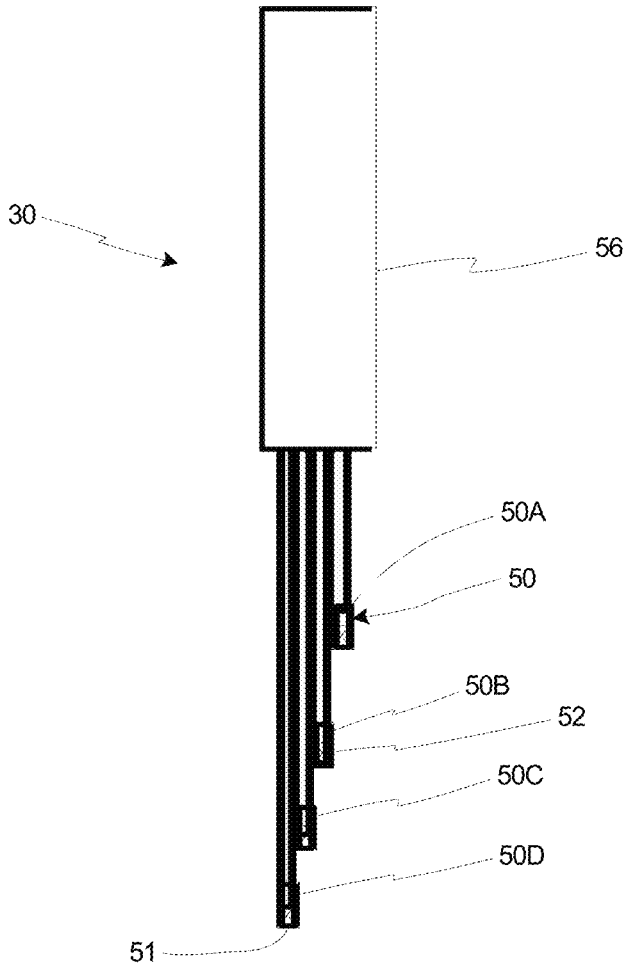
FIG. 1B is an enlarged view of a portion of the water sampler illustrated in FIG. 1A.

It is appreciated that the number of individual sampling tubes 50 within the multilevel bailer 30 can be varied as desired. For example, as shown in FIGS. 1A and 1B, the multilevel bailer 30 can include four individual sampling tubes, i.e. a first sampling tube 50A that is positioned at a first depth 54A, a second sampling tube 50B that is positioned at a second depth 54B, a third sampling tube 50C that is positioned at a third depth 54C, and a fourth sampling tube 50D that is positioned at a fourth depth 54D. Alternatively, the multilevel bailer 30 can include greater than four or fewer than four individual sampling tubes 50. Still alternatively, it is understood that more than one of the sampling tubes 50 can be positioned at any given depth if so desired for sampling purposes.

Further, it is also appreciated that although the depths 54A-54D are all illustrated in FIG. 1A as being defined at one moment in time, the different depths for obtaining or collecting water samples would more likely be achieved by movement of the water sampler 30 within the well 10 between the collection of water samples in order to obtain water samples from specifically desired depths. Stated in another manner, the depths 54A-54D for obtaining or collecting water samples by each sampling tube 50A-50D are not necessarily determined at one particular moment in time, but rather based on desired depths for the water samples.

Additionally, in certain embodiments, all of the sampling tubes 50A-50D are sheathed within a single flexible polymer and/or braided stainless steel jacket 56 that conjoins all of the sampling tubes 50A-50D together, into a single flexible unit. Further, in some applications, the bottom 51 of each sampling tube 50 is staggered with the next sequential sampling tube 50 in the water sampling assembly 12 so that the small tube valves 52 at the bottom 51 of each sampling tube 50 do not pile up onto each other at a single location, which could otherwise unnecessarily increase the diameter of the invention.

Returning now to FIG. 1A, as provided herein and as described in greater detail below, the tube valves 52 can be pneumatically controlled by use of compressed gas at the surface 22. In certain embodiments, the compressed gas control system 32 has a separate pressure gauge and control valve at the surface 22 so that the compressed gas back-pressure for each sampling tube 50 of the multilevel bailer 30 can be independently controlled and pressurized during the sampling process. When all of the sampling tubes 50 are conjoined together, the external maximum diameter of the multilevel bailer 30 is less than one-and-a-half inches and may be as small as one-half inch in outside diameter, depending on the number of sampling tubes 50 and tube valves 52, and the thickness of the protective sheath or jacket 56.

The control system 32 can control and/or regulate various processes related to the obtaining of the water samples, and the subsequent profiling, testing, evaluating and/or diagnosing of the groundwater 14 included within the individual water samples. For example, the control system 32 can be used to control the administration of the water sampler 30 within the groundwater well 10, as well as for processing the results obtained from the water sampler 30 in order to calculate and/or derive the chemistry contributions from each of the water samples that have been removed from the groundwater well 10. Additionally, in certain embodiments, the control system 32 can be further utilized to control, monitor and evaluate the dynamic and ambient flow of the groundwater 14 within the well 10, e.g., based on the use of any potential flow detection assembly.

In some embodiments, the control system 32 can include a computerized system having one or more processors and circuits, and the control system 32 can be programmed to perform one or more of the functions described herein. It is recognized that the positioning of the control system 32 within the water sampling assembly 12 can be varied depending upon the specific requirements of the water sampling assembly 12. In other words, the positioning of the control system 32 illustrated in FIG. 1A is not intended to be limiting in any manner.

Figure 2:
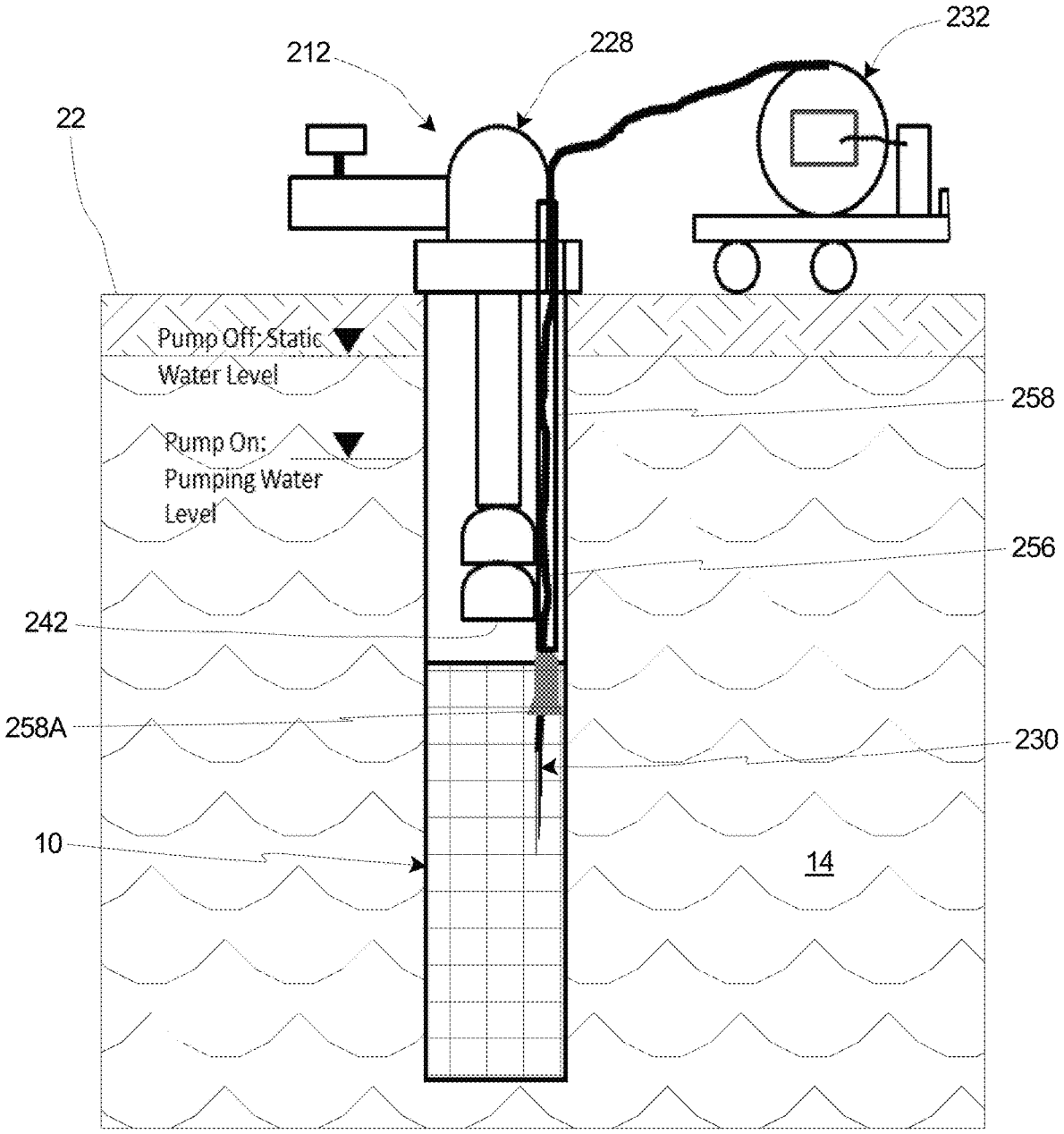
FIG. 2 is a simplified schematic illustration of the groundwater production well and another embodiment of the water sampling assembly.

FIG. 2 is a simplified schematic illustration of the groundwater production well 10 and another embodiment of the water sampling assembly 212. As shown, the water sampling assembly 212 is substantially similar to the water sampling assembly 12 illustrated and described above. For example, the water sampling assembly 212 again includes a primary pump assembly 228, a water sampler 230 and a control system 232 that are substantially similar to the corresponding components illustrated and described above. Accordingly, such components will not be described in detail herein.

However, in this embodiment, the groundwater well 10 further includes an access pipe 258 for purposes of enabling the water sampler 230 to be installed within the groundwater well 10 and positioned below the primary pump 228, i.e. without the need for removing the primary pump 228 from the well 10. In particular, in cases where the annulus 48 (illustrated in FIG. 1A) is too small and the multilevel bailer 230 cannot pass the pump 228 and/or pump collars within the naturally occurring annulus 48, the well owner can remove the primary pump 228 from the well 10 and install an access pipe 258 that extends from the surface 22 to some distance past the pump intake 242 at depth. As illustrated, in some embodiments, the bottom 258A of the access pipe 258 has a flared cone shape with rounded edges so that the polymer and/or braided stainless steel sheath or jacket 256 does not rub against the bottom edge of the access pipe 258 during removal from the well 10. Otherwise, rubbing action between the jacket 256 and the access pipe 258 can peel off strips of the jacket 256 that can then accumulate in the bottom 258A of the access pipe 258 making it difficult to remove the multilevel bailer 230.

It is appreciated that for the purpose of the present invention, it is desired that the primary pump 228 be used and reinstalled with the access pipe 258 back into the well 10. The primary pump 228 provides the actual pumping rate and geometry to create the exact conditions inside the well 10 in order to diagnose any water quality problem that may exist in the groundwater 14 within the well 10. Using a smaller (or larger) pump in place of the primary pump 228 can change the turbulent patterns inside the well 10, and can change the free annular volume inside the well 10, as well as the pumping rate—all of which contribute to potentially changing the distribution of flow and water chemistry of the groundwater 14 within the well 10. The well profiler and diagnostician that is hired to identify the location(s) of any water quality problem(s) inside the well 10 must recreate the exact hydraulic condition in order to accurately identify and solve any water quality problem(s). Although the access pipe 258 does displace a small percentage of annular volume, it is not significant enough to offset water quality distribution in the same manner as a change in pump diameter, pump column diameter and pumping rate.

Referring back to FIG. 1A, to prepare the multilevel bailer 30 for insertion into the well 10, a string of weights (not shown, but preferably formed from stainless steel metal) can be attached to the bottom of the multilevel bailer 30. The weighted multilevel bailer 30 can then be inserted through the annulus 48 into the well 10. It is appreciated that the weights could also be added to the embodiment illustrated in FIG. 2, and the weighted multilevel bailer 230 can be inserted through the access pipe 258 into the well 10.

In various applications, the weights are a valuable asset for the water sampling assembly 12 in that they provide vertical stabilization and inertia for the multilevel bailer 30 within the turbulent well—i.e. maintaining a straight path of descent and egress with minimal swinging and winding as a result of fluid turbulence. Another advantage of the weighted strand is that since it is comprised of multiple weights that are longer in the vertical direction and rounded at both ends, it is allowed to articulate within the well 10 so as to radius around obstructions such as pump collars and the primary pump 28 itself when performing the sampling survey without an access pipe 258. In order to accomplish this procedure, the multilevel bailer 30 is also outfitted with a stainless steel support line (not shown) that is embedded between the sampling tubes 50 on the inside of the exterior protective sheath or jacket 56. The length of the stainless steel support cable extends past the bottom of the deepest tube valve 52 on the multilevel bailer 30, the end of which is comprised of an attachment loop so that the weighted strand can be clamped onto the loop. The weights themselves are typically small in diameter as well, ranging from one-quarter inch outer diameter to as much as one inch outer diameter and are typically three to four inches in length and rounded on both ends of the weight to eliminate sharp angles that may be spatially disruptive to descent and egress from the well 10. In some embodiments, each weight is bored through the center such that the support cable can be threaded through and then terminated at the base of the cable where it exits the last weight located at the end of the weight strand.

Figure 3:
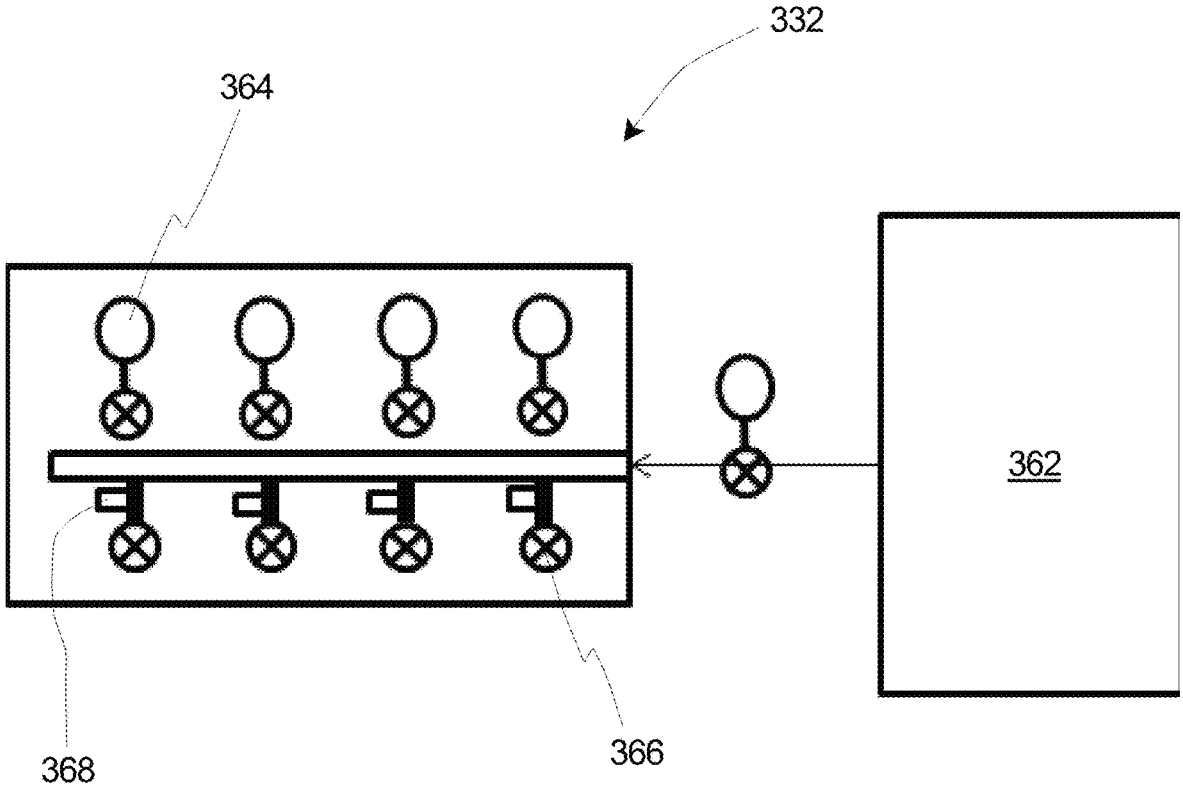
FIG. 3 is a simplified schematic illustration of one embodiment of a control system for use in operation of the water sampling assembly.

FIG. 3 is a simplified schematic illustration of an embodiment of the control system 332 for use in operation of the water sampling assembly 12. As shown in FIG. 3, the preferred method of operation of the multilevel bailer 30 (illustrated in FIG. 1A) is by means of a compressed gas source 362 that can be channeled to the individual sampling tubes 50 (illustrated in FIG. 1A) by way of the surface-based pneumatic control system 332. The compressed gas 362 is first used to pressurize each of the sampling tubes 50 with the appropriate amount of back pressure—typically defined by the deepest sampling location inside the well 10 (illustrated in FIG. 1A) and the greatest amount of hydraulic head. The control system 332 is outfitted with multiple pressure gauges 364 and control valves 366, each gauge/valve pair being assigned and connected to one of the individual sampling tubes 50 inside the exterior sheath 56 (illustrated in FIG. 1A). The pneumatic load that is introduced to the inside of the bailer 30 seats a moveable valve poppet or ball (not shown) inside the valve housing, against an O-ring placed at the bottom of the valve chamber. When the descent pressure that is introduced into the bailer 30 reaches stabilization as indicated by the corresponding pressure gauge 364, the control valve 366 for the corresponding sampling tube 50 is closed such that the descent pressure is trapped inside the sampling tube 50 between the surface control valve 366 and the tube valve 52 (illustrated in FIG. 1B) at the bottom 51 (illustrated in FIG. 1B) of each sampling tube 50. When all of the sampling tubes 50 have been pressurized with the compressed gas 362 and the gas locked into place by closing each corresponding valve 52, 366, the multilevel bailer 30 is then inserted into the front end of the counter (not shown), which can be mechanical, optical, and/or electrical in design. The numerical indicator on the counter is first zeroed and then the multilevel bailer 30 is inserted through the counter.

During operation of the water sampling assembly 12, the groundwater sampling program often begins with descending the multilevel bailer 30 to the shallowest depth first. The pressure for the first sampling tube 50A is released at the surface 22 (illustrated in FIG. 1A) by opening the corresponding control valve 366. The compressed gas 362 is then released to the atmosphere and the corresponding pressure gauge 364 of the control system 332 is monitored to determine when the line pressure inside the specific sampling tube 50 of the multilevel bailer 30 reaches atmospheric pressure. At this point, groundwater 14 (illustrated in FIG. 1A) for the specific depth inside the pumping well 10 can enter through the open tube valve 52 at the bottom 51 of the sampling tube 50. The fill process can be monitored by means of a surface based bubbler apparatus (not shown) connected to a bleed off valve 368 on the control system 332. A tube (not shown) extends from the control valve 366 into a bottle of water (not shown). The air space inside the sampling tube 50 is displaced from the in-filling groundwater 14, and when the groundwater 14 inside the sampling tube 50 reaches static equilibrium with the pumping water level inside the well 10, the bubbling stops—indicating that the sampling tube 50 is full to the pumping water level inside the well 10 with the desired water sample. The sampling tube 50 is then re-pressurized with compressed gas 362 with the same descent pressure as before by closing the corresponding control valve 366 at the surface 22.

The multilevel bailer 30 is then lowered to the next deepest location and the process repeated. The process can be repeated for each of the individual sampling tubes 50 contained within the multilevel bailer 30. For example, if there are four individual sampling tubes 50, then four distinct depths can be sampled with a single trip of the water sampler 30 into the well 10. Alternatively, if there are eight individual sampling tubes 50, then eight distinct depths can be sampled with a single trip of the water sampler 30 into the well 10. Importantly, all such sampling depths can be accessed in series without having to remove the multilevel bailer 30 from the well 10 for each sampling event. Moreover, if the sample volume in a single sampling tube 50 is not enough for any of the sampling depths, then one or more of the conjoined sampling tubes 50 can be added to the same depth to acquire additional volume.

Figure 4:
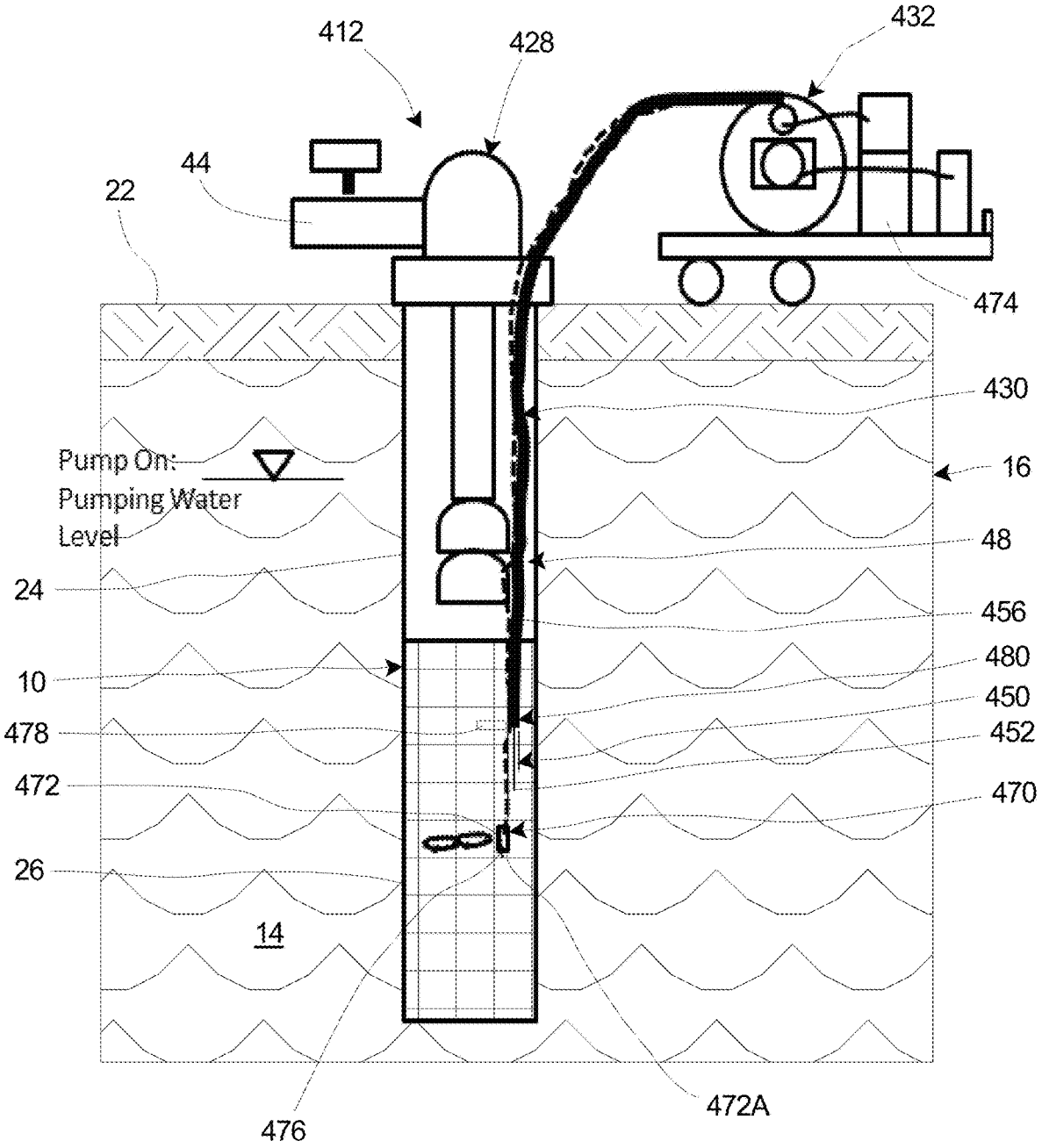
FIG. 4 is a simplified schematic illustration of the groundwater production well and still another embodiment of the water sampling assembly, the water sampling assembly including the water sampler and a flow detection assembly.

Second Embodiment—Miniaturized, Flexible, Multilevel Bailer Conjoined with Miniaturized, Flexible Tracer Injection System for Use Inside Pumping Groundwater Production Wells and Uncased Boreholes FIG. 4 is a simplified schematic illustration of the groundwater production well 10 and still another embodiment of the water sampling assembly 412. As illustrated in this embodiment, the water sampling assembly 412 is somewhat similar to the previously described embodiments. For example, the water sampling assembly 412 again includes a primary pump assembly 428 and a water sampler 430 (i.e. a miniaturized multi-tube, multi-valve, and multilevel bailer) that are similar in design and function to the previous embodiments, and a control system 432 that performs the same basic functions as in the previous embodiments. However, in this embodiment, the water sampling assembly 412 further includes a flow detection assembly 470 for purposes of detecting dynamic and ambient flow of the groundwater 14 within the subsurface environment 16. Additionally, the control system 432 includes additional components and features in order to effectively control the operation of the flow detection assembly 470. As with the previous embodiments, the water sampling assembly 412 is again configured to relatively quickly, inexpensively and accurately identify and locate the source of volatile organic contaminants as well as inorganic contaminants from inside groundwater production wells.

Down-hole and in-well flow metering has been available for decades with various technologies. The purpose of down-hole and in-well flow metering is to determine the fractional flow contributions of fluids from various locations along the length of an open borehole and/or along the screened sections of a well. There are two basic types of flow metering. The first is performed when a pump is pumping inside the borehole or well and is called dynamic flow profiling. The second type is defined as ambient or static flow metering and is performed inside the borehole or well when the pump is not present or is turned off.

The design of the flow detection assembly 470 can be varied. In certain embodiments, as shown in FIG. 4, the flow detection assembly 470 can be a flexible tracer injection system that includes a tracer injection tube 472 (also referred to herein as an "injection tube") that retains a quantity of tracer material 474 (also referred to herein simply as "tracer"), an injection valve 476 that can be positioned near a bottom 472A of the injection tube 472, and one or more tracer detectors 478, e.g., fluorometers, that detect the presence and thus the flow of the tracer 474 within the well 10. Alternatively, the flow detection assembly 470 can have another suitable design.

As with the previous embodiments, the water sampling assembly 412 is able to provide the desired advantages over previous systems in terms of accuracy, time-efficiency and cost-efficiency by minimizing the number of trips into and out of the well 10 by the water sampler 430 and the flow detection assembly 470. As noted above, these multiple trips can unfortunately result in counting errors, which can further lead to sampling depth errors that can create offsets and errors in the data. Further, such offsets and errors can lead to corresponding errors in the decision-making process and in applied rehabilitation procedures. Additionally, as noted above, multiple trips for the bailer into and out of the pumping production well leads to a greater possibility of the bailer getting stuck at some point inside the well. Moreover, the increased number of trips of the bailer into and out of the well results in decreased time efficiency as well as increased costs. Thus, the ability of the present water sampling assembly 412 to minimize the number of trips into and out of the well 10 provides tremendous advantages as compared to previous systems.

Minimizing the number of trips into and out of the well 10 is further enabled due to the physical connection between the water sampler 430 and the flow detection assembly 470. In particular, in various embodiments, the injection tube 472 and all of the sampling tubes 450 are sheathed within a single flexible polymer and/or braided stainless steel jacket 456 that conjoins all of the tubes together, into a single flexible unit. As such, the combination of the water sampler 430 and the flow detection assembly 470 is sometimes referred to as a conjoined sampling and flow detecting system 480, or simply as a "conjoined system". There is no current technology that conjoins the tracer injection apparatus with a multilevel bailer apparatus as is shown in FIG. 4.

As with the previous embodiments, the bottom of each tube 450, 472 is staggered with the next sequential tube in the conjoined system 480 so that the small valves 452, 476 at the bottom of each tube 450, 472 do not pile up onto each other at a single location, which could unnecessarily increase the diameter of the invention.

Additionally, similar to previous embodiments, the conjoined system 480 can be installed into the groundwater well 10 and below the pump assembly 428 without removing the pump assembly 428 from the well 10 or with the pump assembly 428 positioned at least partially therein. For example, in the embodiment illustrated in FIG. 4, the conjoined system 480 of the water sampler 430 and the flow detection assembly 470 is installed into the well via the annulus 48 between the pump assembly 428 and the support casing 24 and/or between the pump assembly 428 and the well screen 26. Alternatively, in some embodiments, an access pipe 558 (illustrated in FIG. 5) can be installed into the well 10 to provide access for the conjoined system 480 into the well 10 and below the pump assembly 428.

During operation of the flow detection assembly 470, flow production inside of a pumping groundwater production well 10 (along the length of the well screen 26) can be measured by means of the tracer 474, which can be selectively released into the well 10 at different depths. In some embodiments, the tracer 474 used for such measurements that has been approved by the National Sanitation Foundation is referred to as NSF 60, which has been approved for use in potable drinking water wells. Additionally and/or alternatively, the tracer 474 can be another substance that has been approved by the NSF or some other organization or agency. For example, in certain non-exclusive alternative embodiments, the tracer 474 can be a substance referred to as rhodamine red FWT 50—which is nontoxic, non-carcinogenic and biodegradable, and which asymptotically approaches the specific gravity of water. Still alternatively, the tracer 474 can be another suitable material or substance.

With the noted general design for the flow detection assembly 470, for each of dynamic and ambient flow testing, the tracer 474 is injected sideways within the well 10 by opening the injection valve 476 at the bottom 472A of the injection tube 472. The tracer 474 is directed out of the injection tube 472 such that the entire cross-sectional area of the well 10 is blanketed by the tracer 474 at each measurement depth. The return curve formed when the tracer 474 passes through the tracer detector 478 (e.g., a fluorometer that may be positioned above and/or below the level at which the tracer 474 is injected within the well 10) is the bulk average, cumulative flow rate at that depth. In particular, in certain applications, an up-hole tracer detector 478 (e.g., fluorometer) measures and records the return time of the tracer 474 from the tracer release point at each depth inside the well 10. The tracer detector 478 can be connected to the well 10 by means of a hose that is connected to the discharge pipe 44 on one end and to the tracer detector 478 on the other end. When the tracer 474 returns to the surface 22, a small fraction of the groundwater 14 moving into the discharge pipe 44 also moves into the hose that runs between the discharge pipe 44 and tracer detector 478. By knowing the travel time of the tracer 474 back to the tracer detector 478 from each release point, knowing the depth of each release point, and knowing the cross-sectional surface area of the well 10 at each release point, the Continuity Equation can be applied to determine the volume and percentage of cumulative flow from each pair of consecutive release points. Subsequently, iterative algebraic subtraction between sequential pairs of cumulative flow values yield zonal contributions of fluid volume entering the well 10 over a given period of time (e.g., in gallons per minutes (GPM)). Once the flow values are derived from the use and application of the flow detection assembly 470, the cumulative flow data is integrated within the mass balance equation such that the associated cumulative chemistry at each depth is flow weighted through an iterative calculation. In this way, the zonal chemistry associated with each flow contribution zone is derived.

As provided above, in addition to controlling the operation of the water sampler 430, the control system 432 also controls the operation of the flow detection assembly 470. In particular, the control system 432 can include a tracer injection control apparatus that is located at the surface 22. The tracer injection control apparatus forces the tracer 474 into the injection tube 472 by means of an injection motor and pump, thus forcing open the injection valve 476 at the bottom 472A of the injection tube 472. The portion of the control system 432 designed to control the operation of the flow detection assembly 470 will be described in greater detail herein below in relation to FIG. 6.

Figure 5:
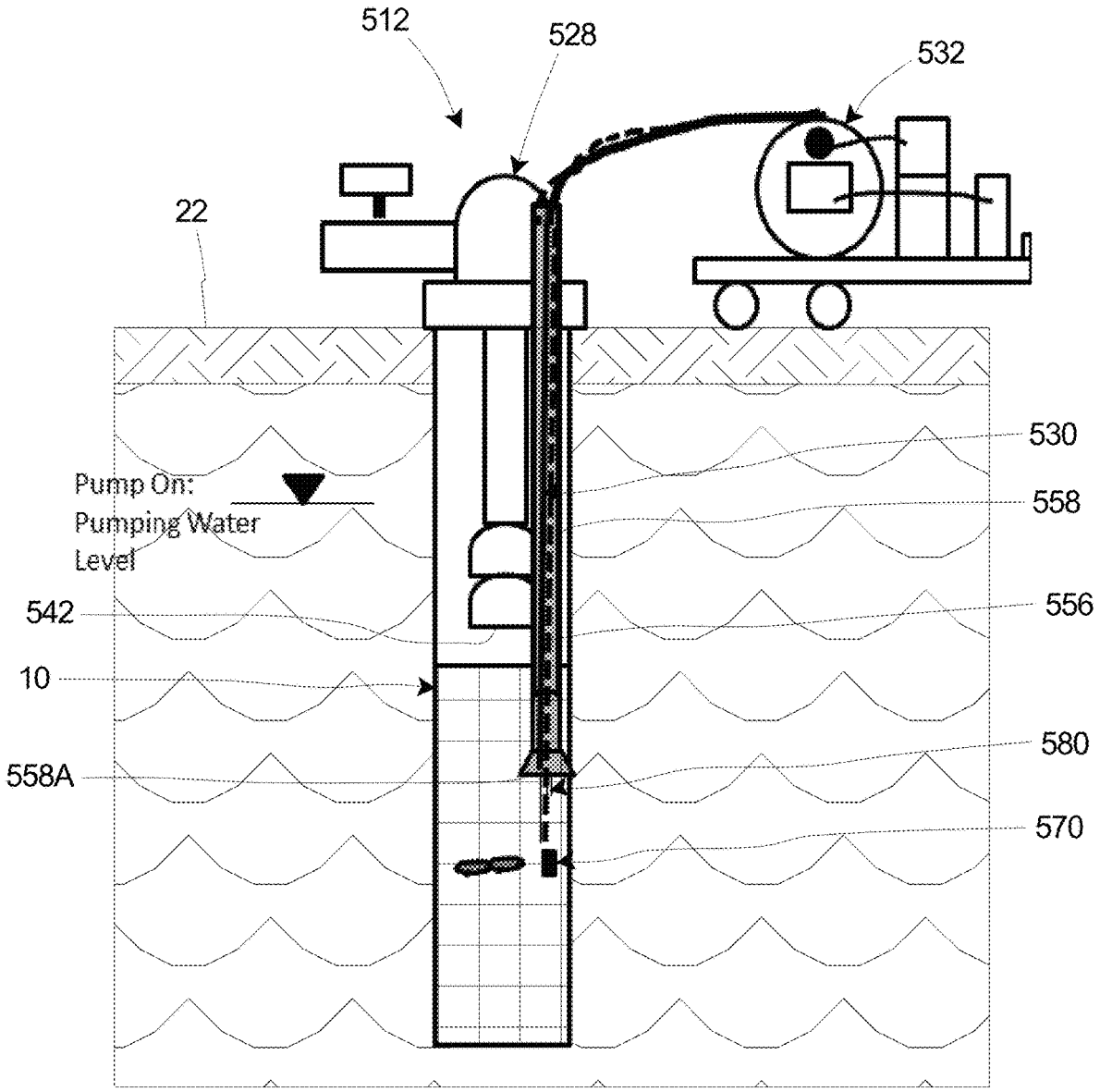
FIG. 5 is a simplified schematic illustration of the groundwater production well and another embodiment of the water sampling assembly.

FIG. 5 is a simplified schematic illustration of the groundwater production well 10 and another embodiment of the water sampling assembly 512. As shown, the water sampling assembly 512 is substantially similar to the water sampling assembly 412 illustrated and described above in relation to FIG. 4. For example, the water sampling assembly 512 again includes a primary pump assembly 528, a water sampler 530, a flow detection assembly 570 and a control system 532 that are substantially similar to the corresponding components illustrated and described above. Accordingly, such components will not be described in detail herein.

However, in this embodiment, the groundwater well 10 further includes an access pipe 558 for purposes of enabling the conjoined system 580 of the water sampler 530 and the flow detection assembly 570 to be installed within the groundwater well 10 and positioned below the primary pump 528, i.e. without the need for removing the primary pump 528 from the well 10. In particular, in cases where the annulus 48 (illustrated in FIG. 4) is too small and the conjoined system 580 cannot pass the pump 528 and/or pump collars within the naturally occurring annulus 48, the well owner can remove the primary pump 528 from the well 10 and install an access pipe 558 that extends from the surface 22 to some distance past the pump intake 542 at depth. As in the embodiment shown in FIG. 2, in some embodiments, the bottom 558A of the access pipe 558 has a flared cone shape with rounded edges so that the polymer and/or braided stainless steel sheath or jacket 556 does not rub against the bottom 558A of the access pipe 558 during removal from the well 10. Otherwise, rubbing action between the jacket 556 and the access pipe 558 can peel off strips of the jacket 556 that can then accumulate in the bottom 558A of the access pipe 558 making it difficult to remove the conjoined system 580.

Additionally, as above, it is important for the purpose of the invention that the primary pump 528 be used and reinstalled with the access pipe 558 back into the well 10. This again enables the well profiler and diagnostician to best recreate the exact hydraulic conditions within the well 10 in order to most accurately diagnose and solve any water quality problems within the well 10.

With respect to the embodiments illustrated in both FIG. 4 and FIG. 5, and similar to the previous embodiments, to prepare the conjoined system 480, 580 for insertion into the well 10, there can be a string of weights (preferably stainless steel metal) that is attached to the bottom of the water sampler 430, 530 and/or the flow detection assembly 470, 570. The weighted system can be inserted through the annulus 48 or access pipe 558 into the well 10. The weights again provide vertical stabilization and inertia for the conjoined system 480, 580 within the turbulent well 10.

Figure 6:
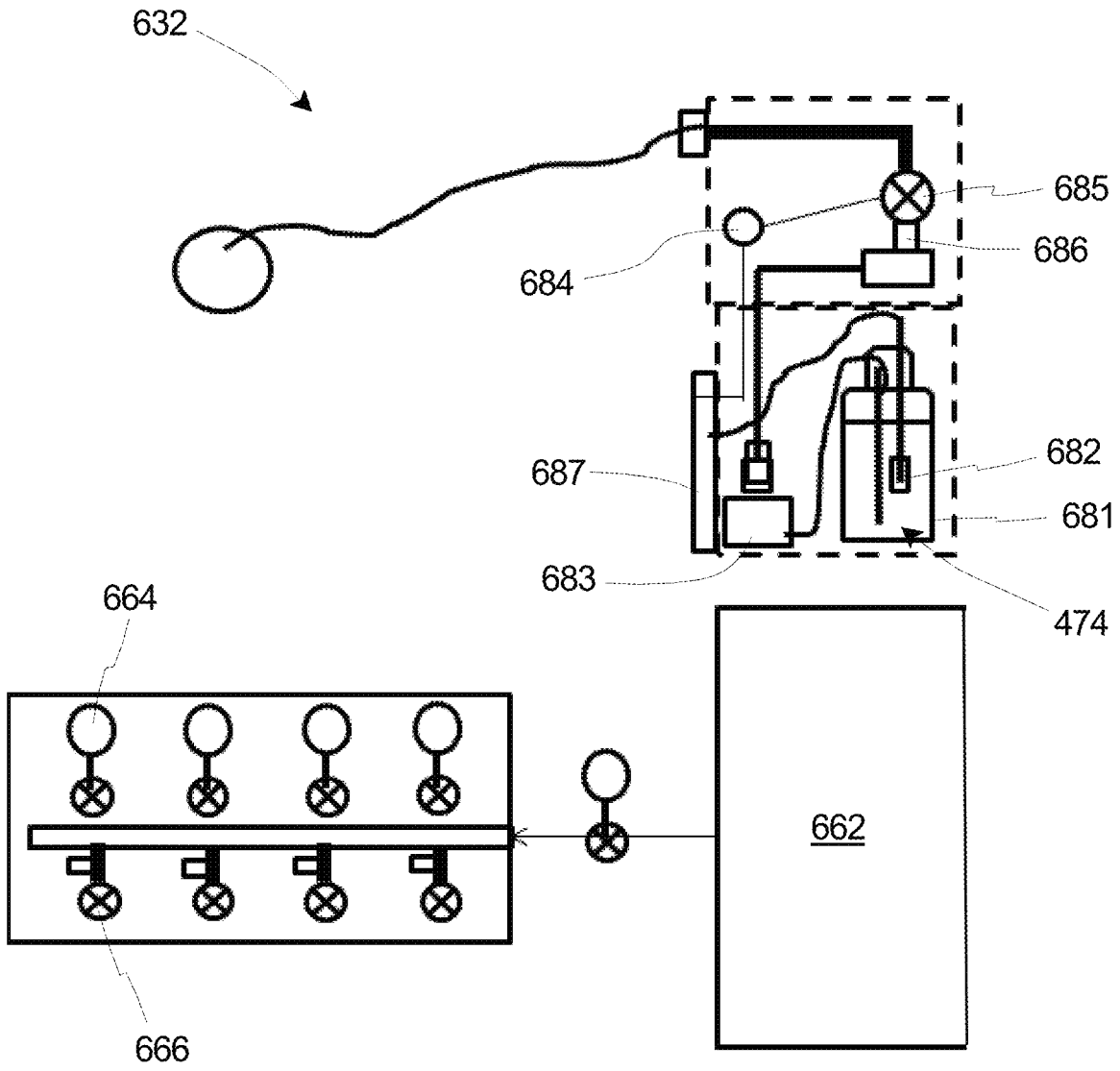
FIG. 6 is a simplified schematic illustration of an embodiment of the control system for use in operation of the water sampling assembly.

FIG. 6 is a simplified schematic illustration of an embodiment of the control system 632 for use in operation of the water sampling assembly 412. As shown in FIG. 6, the preferred method of operation of the multilevel bailer 430 (illustrated in FIG. 4) is again by means of a compressed gas source 662 that can be channeled to the individual sampling tubes 450 (illustrated in FIG. 4) by way of the surface-based pneumatic control system 632. The channeling of the compressed gas 662 is again accomplished through the use of multiple pressure gauges 664 and control valves 666, each gauge/valve pair being assigned and connected to one of the individual sampling tubes 450 inside the exterior sheath or jacket 456 (illustrated in FIG. 4).

Further, the control system 632 includes additional components for controlling operation of the flow detection assembly 470 (illustrated in FIG. 4). In particular, as shown, the control system 632 can further include a fluid reservoir 681, a fluid level sensor 682, an injection motor and pump 683, an injection switch 684, a switching valve 685, a backflow prevention valve 686, and a power supply 687. Alternatively, this portion of the control system 632 that controls operation of the flow detection assembly 470 can include more components or fewer components than those specifically mentioned herein.

The fluid reservoir 681 is configured to retain a volume of the tracer material 474 that is used for measuring the flow of the groundwater 14 (illustrated in FIG. 4) within the well 10 (illustrated in FIG. 4). It is appreciated that the fluid reservoir 681 can have any suitable size and shape, and the fluid reservoir 681 can be configured to retain any desired volume of the tracer material 474.

The fluid level sensor 682 senses the level of the tracer material 474 within the fluid reservoir 681, i.e. to make sure a sufficient volume of the tracer material 474 is available for purposes of conducting the desired flow detection within the well 10. The fluid level sensor 682 can have any suitable design. For example, in one non-exclusive alternative embodiment, the fluid level sensor 682 is a float-type sensor. Alternatively, the fluid level sensor 682 can have another suitable design.

The injection motor and pump 683 is configured to move the tracer material 474 into (and out of) the injection tube 472 (illustrated in FIG. 4). More specifically, the injection motor and pump 683 forces the tracer 474 into the injection tube 472, and thus forces open the injection valve 476 (illustrated in FIG. 4) at the bottom 472A (illustrated in FIG. 4) of the injection tube 472. Thus, the tracer 474 is injected sideways into the groundwater 14 within the well 10 as described above.

The injection switch 684 is a control switch that is utilized to activate the switching valve 685, e.g., an electromechanical solenoid switching valve. Generally speaking, the switching valve 685 is movable between an open position, when tracer material 474 is allowed to flow from the fluid reservoir 681 to the injection tube 472 via the force provided by the injection motor and pump 683; and a closed position, when tracer material 474 is inhibited from flowing to the injection tube 472. As noted, the control system 632 can further including the backflow prevention valve 686, which inhibits the tracer material 474 from flowing back toward the fluid reservoir 681.

The power supply 687 provides the necessary power for operation of the control system 632. The power supply 687 can be include an AC power supply and/or a DC power supply.

During operation of the water sampling assembly 412, the groundwater sampling program often begins with descending the conjoined system 480 to the shallowest depth first. At this point, a flow meter measurement can be made by releasing a small volume of tracer 474 into the pumping well 10 and waiting for the arrival time of the tracer 474 back to an up-hole tracer detector 478. During the return time for the tracer 474, a corresponding, co-located water sample can be collected into one of the sampling tubes 450 by release of the pneumatic pressure for one of the control valves 666. Although there is a small offset between the tube valve 452 and the injection valve 476, the vertical offset distance is very small (that being just a few inches of separation) such that the offset does not detract from the data value of the co-located pair. The pressure for the first sampling tube 450 is released at the surface 22 by opening the corresponding control valve 666. The compressed gas 662 is then released to the atmosphere and the corresponding pressure gauge 664 of the control system 632 is monitored to determine when the line pressure inside the specific sampling tube 450 reaches atmospheric pressure. At this point, groundwater 14 for the specific depth inside the pumping well 10 can enter through the open tube valve 452 at the bottom 451 of the sampling tube 450 until the sampling tube 450 is full to the pumping water level inside the well 10 with the desired water sample. The sampling tube 450 is then re-pressurized with compressed gas 662 with the same descent pressure as before by closing the corresponding control valve 666 at the surface 22.

The conjoined system 480 is then lowered to the next deepest location and the process repeated. The process can be repeated for each of the individual sampling tubes 450 contained within the conjoined system 480.

Figure 7:
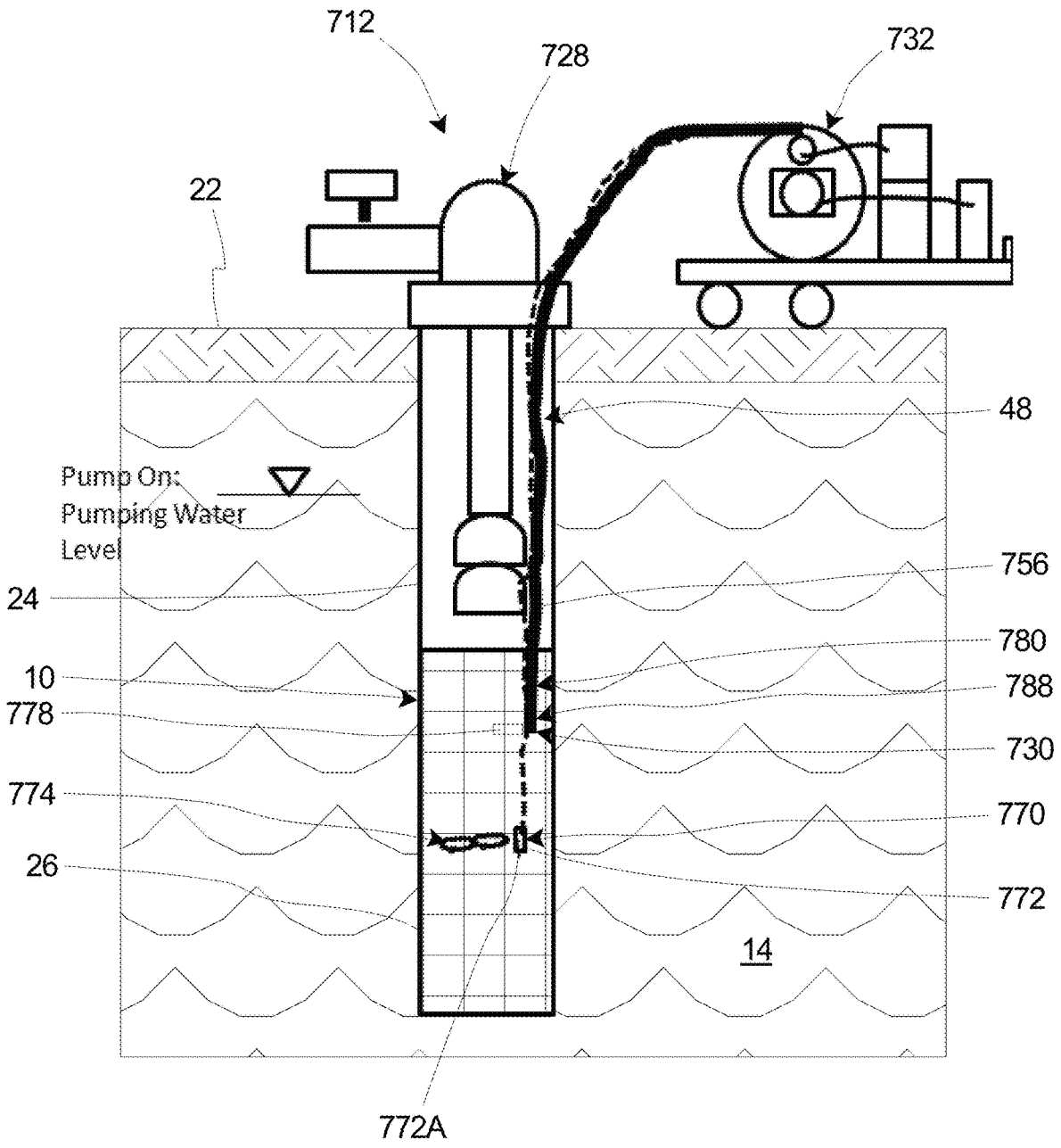
FIG. 7 is a simplified schematic illustration of the groundwater production well and another embodiment of the water sampling assembly, the water sampling assembly including another embodiment of the water sampler and the flow detection assembly.

Third Embodiment—Miniaturized, Flexible Pump Conjoined with Miniaturized, Flexible Tracer Injection System for Use Inside Pumping Groundwater Production Wells and Uncased Boreholes FIG. 7 is a simplified schematic illustration of the groundwater production well 10 and another embodiment of the water sampling assembly 712. As illustrated in this embodiment, the water sampling assembly 712 is somewhat similar to the water sampling assemblies illustrated and described above. More particularly, the water sampling assembly 712 is somewhat similar to the water sampling assembly 412 illustrated and described above in relation to FIG. 4. For example, the water sampling assembly 712 again includes a primary pump assembly 728 that is substantially similar to the primary pump assembly 428 illustrated and described above. Additionally, the water sampling assembly 712 also includes a flow detection assembly 770 that is substantially similar in design and function to the flow detection assembly 470 illustrated and described above. Further, the control system 732 is also configured to control the flow detection assembly 770 in a similar manner as to what was described in detail above. Accordingly, the pump assembly 728, the flow detection assembly 770 and the portion of the control system 732 that controls the flow detection assembly 770 will not again be described in great detail herein.

However, in this embodiment, the water sampler 730 has a different design than what was illustrated and described above. In particular, as shown in FIG. 7, the water sampler 730 includes a miniaturized, flexible pump 788 that works in conjunction with the flow detection assembly 770, i.e. the miniaturized, flexible tracer injection system. As utilized herein, the term "flexible" to refer to the miniaturized pump 788 and/or the tracer injection system 770 refers to the flexibility provided by such components as a means to work around and/or bypass such components within the well 10.

As with the previous embodiments, the water sampling assembly 712 is again configured to relatively quickly, inexpensively and accurately identify and locate any potential sources of volatile organic contaminants and inorganic contaminants from inside the groundwater production well 10.

As provided above in the discussion of the embodiment illustrated in FIG. 4, in this embodiment, flow production inside of the pumping groundwater production well 10 (e.g., along the length of the well screen 26) can be measured via the flow detection assembly 770 by means of tracer materials 774 that are selectively released into the well 10 at different depths. An up-hole tracer detector 778, e.g., fluorometer, can then be used to measure and record the return time from the release point at each depth inside the well 10. In this manner, the flow of the groundwater 14 within the well 10, both dynamic and ambient flow, can be effectively determined at each depth.

Following this effort, the miniaturized groundwater sampling pump 788 (also sometimes referred to herein as a "hydrobooster" sampling pump or simply a "sampling pump") can then be utilized to collect depth dependent groundwater samples from within the well 10. As provided herein, the sampling pump 788 can be lowered from location to location inside the well 10 to collect the desired water sample without having to remove the sampling pump 788 from the well 10 between sampling events. It is appreciated that each of the sampling pump 788 and the previously described multilevel bailer 430 technology for the water sampler provide certain advantages for collecting and preserving inorganic contaminant constituents or for collecting and preserving volatile organic compounds from different depths in the well 10.

As with the previous embodiments, the water sampling assembly 712 is again able to provide the desired advantages over previous systems in terms of accuracy, time-efficiency and cost-efficiency by minimizing the number of trips into and out of the well 10 by the sampling pump 788 and the flow detection assembly 770. As noted above, these multiple trips can unfortunately result in counting errors, which can further lead to sampling depth errors that can create offsets and errors in the data. Further, such offsets and errors can lead to corresponding errors in the decision-making process and in applied rehabilitation procedures. Additionally, the separate round trips for the tracer injection tube and the sampling pump into and out of the pumping production well 10 leads to an increased probability that the tubing from one of the tools will become stuck at some point inside the well 10. Moreover, the separate round trips for the tracer injection tube and the sampling pump can result in a longer project timeline, which can further result in increased costs.

Minimizing the number of trips into and out of the well 10 with the current system is further enabled due to the physical connection between the sampling pump 788 and the flow detection assembly 770. In particular, in various embodiments, the tracer injection tube 772 and the sampling pump 788 are sheathed within a single flexible polymer and/or braided stainless steel jacket 756 that conjoins them together into a single flexible unit. As such, the combination of the sampling pump 788 and the flow detection assembly 770 can again sometimes referred to as a conjoined sampling and flow detecting system 780, or simply as a "conjoined system".

Thus, the new conjoined system 780 helps to minimize and/or eliminate the counter error as described earlier by minimizing the number of trips into and out of the well 10. In particular, the invention consists of the flow detection assembly 770, i.e. the tracer injection tube and valve apparatus, conjoined with the miniaturized sampling pump 788, with the conjoined system 780 being able to be lowered to multiple flow metering and sampling depths in a single trip into and out of the well 10. Thus, the conjoined system 780 is not removed from the well 10 between all sampling events and/or flow metering events. The flow detection assembly 770 only requires one injection tube 772 since the tracer 774 can be injected at multiple sequential depths and is not used for the sample collection itself. The miniaturized sampling pump 788 only requires a minimum of two tubes (or lines) since one line is used for inserting compressed gas and the other line for the sample return flow. The bottom 772A of the tracer injection tube 772 is staggered with the miniaturized sampling pump 788 so that the small parts and valves at the end of each tube do not pile up on each other at a single location, which could unnecessarily increase the diameter of the invention. As discussed herein, the tracer injection and miniaturized pump valves are pneumatically controlled by use of compressed gas at the surface 22. The compressed gas control system 732 has a separate pressure gauge and control valve at the surface 22 so that the compressed gas backpressure for the tracer injection system and for the miniaturized sampling pump 788 can be independently controlled and pressurized during the sampling process. The portion of the control system 732 designed to control the operation of the sampling pump 788 will be described in greater detail herein below.

Additionally, as with previous embodiments, the conjoined system 780 can be installed into the groundwater well 10 and below the pump assembly 728 without removing the pump assembly 728 from the well 10 or with the pump assembly 728 positioned at least partially therein. In the embodiment illustrated in FIG. 7, the conjoined system 780 of the sampling pump 788 and the flow detection assembly 770 can be installed into the well via the annulus 48 between the pump assembly 728 and the support casing 24 and/or between the pump assembly 728 and the well screen 26. Alternatively, in some embodiments, an access pipe 858 (illustrated in FIG. 8) can be installed into the well 10 to provide access for the conjoined system 780 into the well 10 and below the pump assembly 728.

Figure 8:
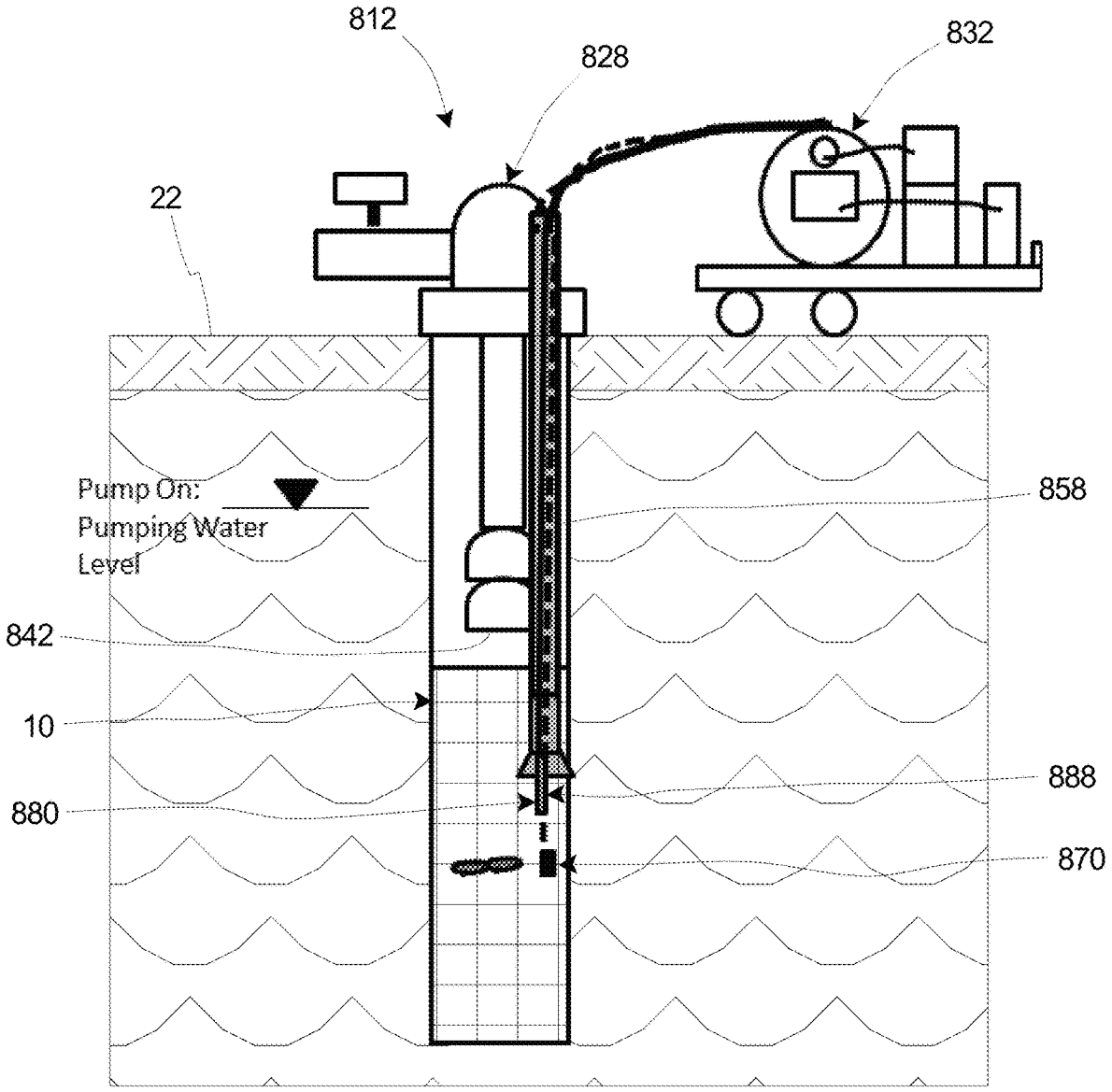
FIG. 8 is a simplified schematic illustration of the groundwater production well and another embodiment of the water sampling assembly.

FIG. 8 is a simplified schematic illustration of the groundwater production well 10 and another embodiment of the water sampling assembly 812. As shown, the water sampling assembly 812 is substantially similar to the water sampling assembly 712 illustrated and described above in relation to FIG. 7. For example, the water sampling assembly 812 again includes a primary pump assembly 828, a miniaturized sampling pump 888, a flow detection assembly 870 and a control system 832 that are substantially similar to the corresponding components illustrated and described above. Accordingly, such components will not be described in detail herein.

However, in this embodiment, the groundwater well 10 further includes an access pipe 858 for purposes of enabling the conjoined system 880 of the sampling pump 888 and the flow detection assembly 870 to be installed within the groundwater well 10 and positioned below the primary pump 828, i.e. without the need for removing the primary pump 828 from the well 10. In particular, in cases where the annulus 48 (illustrated in FIG. 7) is too small and the conjoined system 880 cannot pass the pump 828 and/or pump collars within the naturally occurring annulus 48, the well owner can remove the primary pump 828 from the well 10 and install an access pipe 858 that extends from the surface 22 to some distance past the pump intake 842 at depth.

With respect to the embodiments illustrated in both FIG. 7 and FIG. 8, and similar to the previous embodiments, to prepare the conjoined system 780, 880 for insertion into the well 10, there can be a string of weights (preferably stainless steel metal) that can be attached to the bottom of the sampling pump 788, 888 and/or the flow detection assembly 770, 870. The weighted system can be inserted through the annulus 48 or access pipe 858 into the well 10. The weights again provide vertical stabilization and inertia for the conjoined system 780, 880 within the turbulent well 10.

Figure 9A:
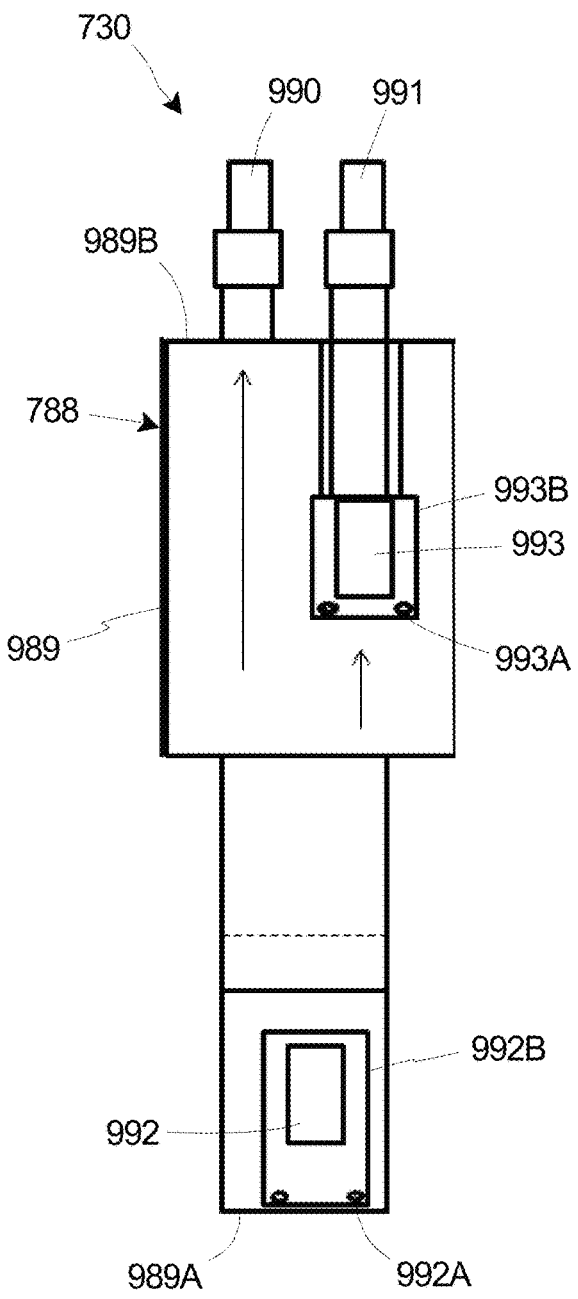
FIGS. 9A and 9B are simplified schematic illustrations of an example of the operation of the water sampler.
Figure 9B:
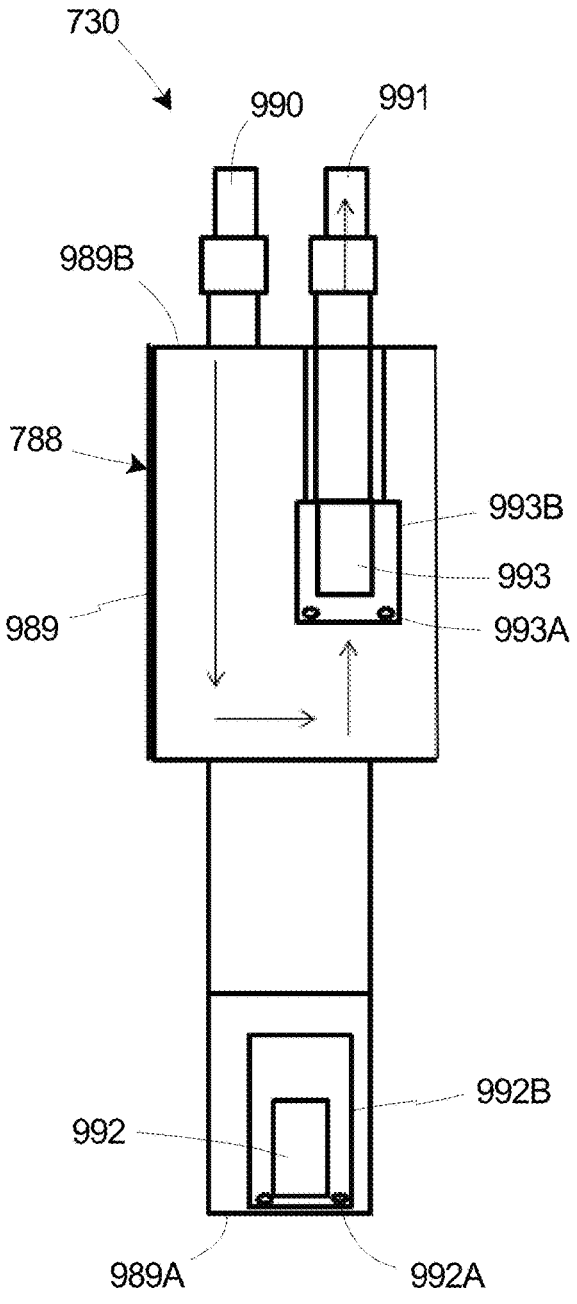

FIGS. 9A and 9B are simplified schematic illustrations of an example of the design and operation of the water sampler 730, i.e. the miniaturized sampling pump 788. More specifically, FIG. 9A illustrates the condition of the sampling pump 788 during a recharge operation, i.e. when a groundwater sample is being collected within the sampling pump 788. Additionally, FIG. 9B illustrates the condition of the sampling pump 788 during a discharge operation, i.e. when the groundwater sample that has been collected within the sampling pump 788 is discharged to the surface 22 (illustrated in FIG. 7).

The design of the sampling pump 788 can be varied. For example, in the embodiment illustrated in FIGS. 9A and 9B, the sampling pump 788 includes a pump body 989 including a pump base 989A and a pump top 989B, a gas supply line 990 (also referred to herein simply as a "supply line"), a groundwater return line 991 (also referred to herein simply as a "return line"), a base valve 992 (or "foot valve"), and a return valve 993. Additionally and/or alternatively, the sampling pump 788 can include more components or fewer components than those specifically noted herein. For example, in some non-exclusive alternative embodiments, the sampling pump 788 can be designed without the return valve 993.

Figure 10:
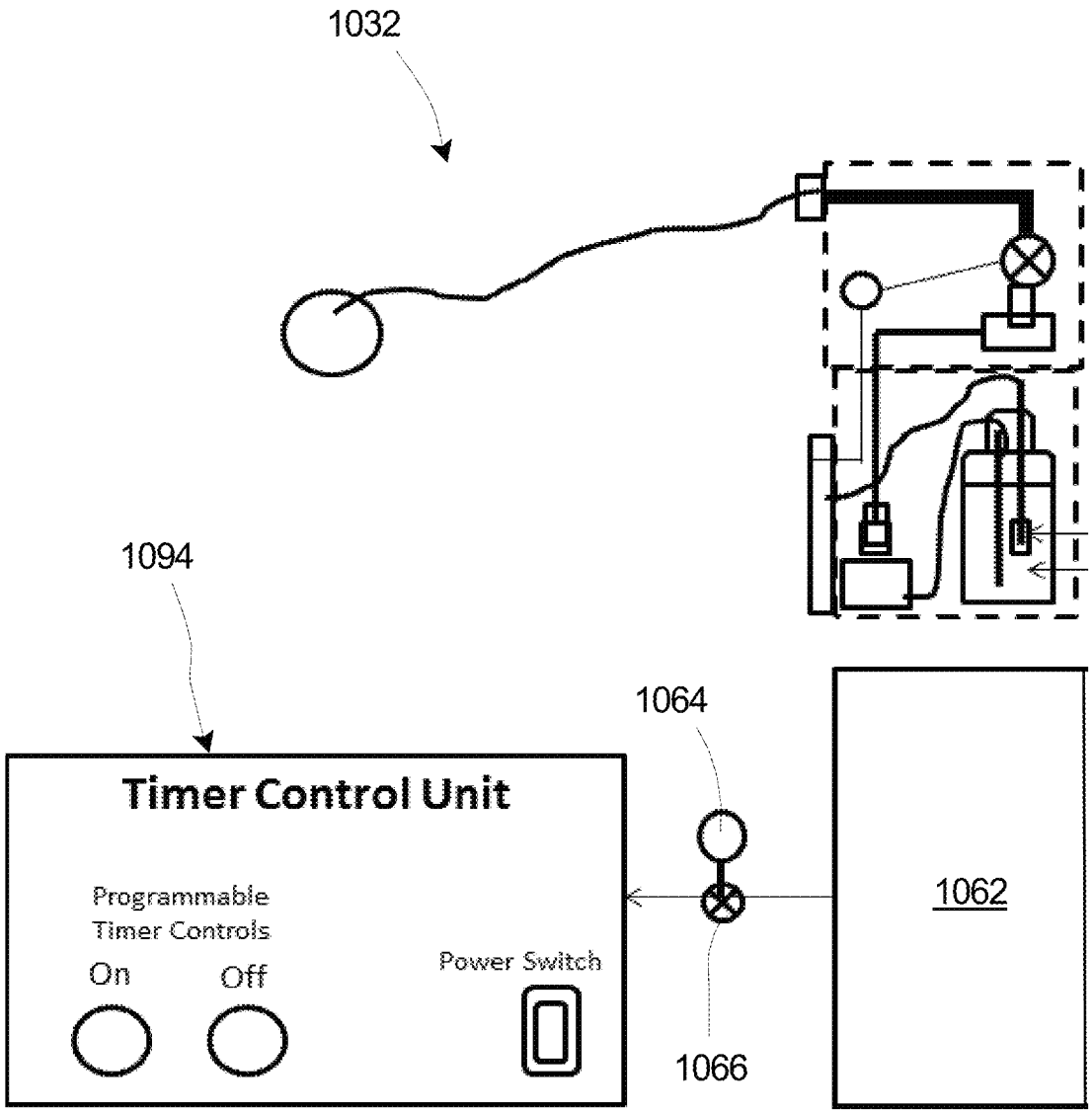
FIG. 10 is a simplified schematic illustration of an embodiment of the control system for use in operation of the water sampling assembly.

FIG. 10 is a simplified schematic illustration of an embodiment of the control system 1032 for use in operation of the water sampling assembly 712. In particular, the portion of the control system 1032 that controls the operation of the flow detection assembly 770 (illustrated in FIG. 7) is substantially similar to that portion of the control system 632 as illustrated and described in relation to FIG. 6. Accordingly, such operation will not be repeated in detail.

Additionally, the control system 1032 is further configured to control the operation of the sampling pump 788 (illustrated in detail in FIGS. 9A and 9B) for purposes of collecting water samples at various depths within the groundwater production well 10 (illustrated in FIG. 7).

The preferred method of operation of the miniaturized sampling pump 788 is by means of a compressed gas source 1062 that can be channeled to the gas supply line 990 by way of the surface based pneumatic control system 1032. The compressed gas 1062 is used to pressurize the gas supply line 990 with the appropriate amount of gas-displacement, drive force pressure, which is defined by the depth of each sampling location inside the well 10 and the greatest amount of hydraulic head.

As illustrated in FIGS. 9A and 9B, the supply line 990 and the return line 991 are positioned near and/or are coupled to the pump top 989B of the pump body 989, and extend away from the pump top 989B toward the surface 22 (illustrated in FIG. 7). As noted, the supply line 990 provides a conduit for the compressed gas 1062 into and out of the pump body 989. Somewhat similarly, the return line 991 provides a conduit for the groundwater samples that have been collected within the pump body 989 to be directed toward the surface 22.

The base valve 992 and the return valve 993 cooperate to control and regulate the flow of the groundwater 14 (illustrated in FIG. 7) into the pump body 989 and out of the pump body 989 toward the surface 22, respectively. The base valve 992 moves between a closed position, where the base valve 992 is positioned directly adjacent to a base valve seal 992A, e.g., an o-ring, within a base valve housing 992B; and an open position, where the base valve 992 is positioned away from the base valve seal 992A so as to allow groundwater 14 to enter into the pump body 989. Somewhat similarly, the return valve 993 moves between a closed position, where the return valve 993 is positioned directly adjacent to a return valve seal 993A, e.g., an o-ring, within a return valve housing 993B to inhibit any groundwater sample within the pump body 989 from entering the return line 991; and an open position, where the return valve 993 is positioned away from the return valve seal 993A so as to allow the groundwater sample to enter the return line 991.

During a recharge operation, as shown in FIG. 9A, the base valve 992 is in the open position to allow the groundwater sample to enter into the pump body 989. Additionally, during the recharge operation, the compressed gas 1062 (illustrated in FIG. 10) within the pump body 989 is directed back to the supply line 990.

Conversely, during a discharge operation, the base valve 992 is in the closed position, and the return valve 993 is in the open position.

As shown in FIG. 10, the control system 1032 is outfitted with one or more pressure gauges 1064 and control valves 1066, with each gauge/valve pair being assigned and connected to one or more gas supply lines 990 for the miniaturized sampling pump 788. The pneumatic load that is introduced to the inside of the pump body 989 seats the base valve 992, e.g., the moveable valve poppet or ball inside the base valve housing 992B, against the base valve seal 992A placed at the bottom of the base valve housing 992B. This being the case, the compressed gas 1062 moves in the form of a u-turn at the bottom of the gas supply line 990, where it transitions into the return line 991. The base valve 992 below the "U-turn" remains seated against the base valve seal 992A at the bottom of the valve housing 992B as the groundwater from the return line 991 is being discharged at the surface 22. The return valve 993, as shown in FIGS. 9A and 9B, is located just above the base valve 992 and near the bottom of the return line 991. The advantage of using the return valve 993 in the return line 991 is for back-flow prevention of the groundwater sample moving up the return line 991 to the surface 22.

In the case where there is only one valve (i.e. the base valve 992 and not the return valve 993), the typical operation is where all of the groundwater 14 inside the gas supply line 990 and return line 991 are displaced by the compressed gas 1062 and discharged at the surface 22 for each pump stroke. However, in the scenario where two valves are used (i.e. the base valve 992 and the return valve 993), a timer control unit 1094 (illustrated in FIG. 10) is typically employed where an on and off cycle of pressurization from the compressed gas source 1062 can be alternated. In the on cycle, the compressed gas 1062 is supplied to the gas supply line 990 where gas volume and pressure are allowed to increase to the point where the water column inside the gas supply line 990 is displaced into the return line 991—and past the one-way return valve 993 near the bottom of the sampling pump 788. The on cycle can be of any time duration, with the longer the duration the more groundwater 14 inside the gas supply line 990 being displaced downward. In conjunction with this mode of operation the more vertical descent of the groundwater column inside the gas supply line 990, the more vertical rise of the groundwater column in the return line 991. Conversely, the off cycle is characterized by release of the compressed gas pressure for a programmed amount of time on the timer control unit 1094. The purpose of the off cycle is to allow the gas supply line 990 to recharge with new water from the well 10 in order to reload the gas supply line 990. The new water in the gas supply line 990 is pushed downward inside the gas supply line 990 once more, causing the water in the return line 991 to rise closer to the surface 22. The on and off cycles comprise a ratcheting rhythm programmed time elements in the gas on and off position inside the timer control unit 1094. The alternation produces a pulsating continuous sample flow stream exiting the return line 991 at the surface 22.

During operation of the sampling pump 788, as above, the groundwater sampling program often begins with descending to the shallowest depth first. The lift pressure for the first event is calculated and the compressed gas pressure set to the pressure accordingly. The timer control unit 1094 is turned on and the amount of time for the on and off cycles programmed into the unit. During the off cycle, the fill process of the gas supply line 990 can be monitored by means of a surface based bubbler apparatus connected to a bleed off valve of the control system 1032. A tube extends from the control unit valve into a bottle of water. Once the gas supply line 990 and the return line 991 have been purged of any non-representative groundwater, the sample is then collected from the return line 991. The miniaturized sampling pump 788 is then lowered to the next deepest location and the process repeated. The process can be repeated for as many individual depths to be sampled.

Figure 11:
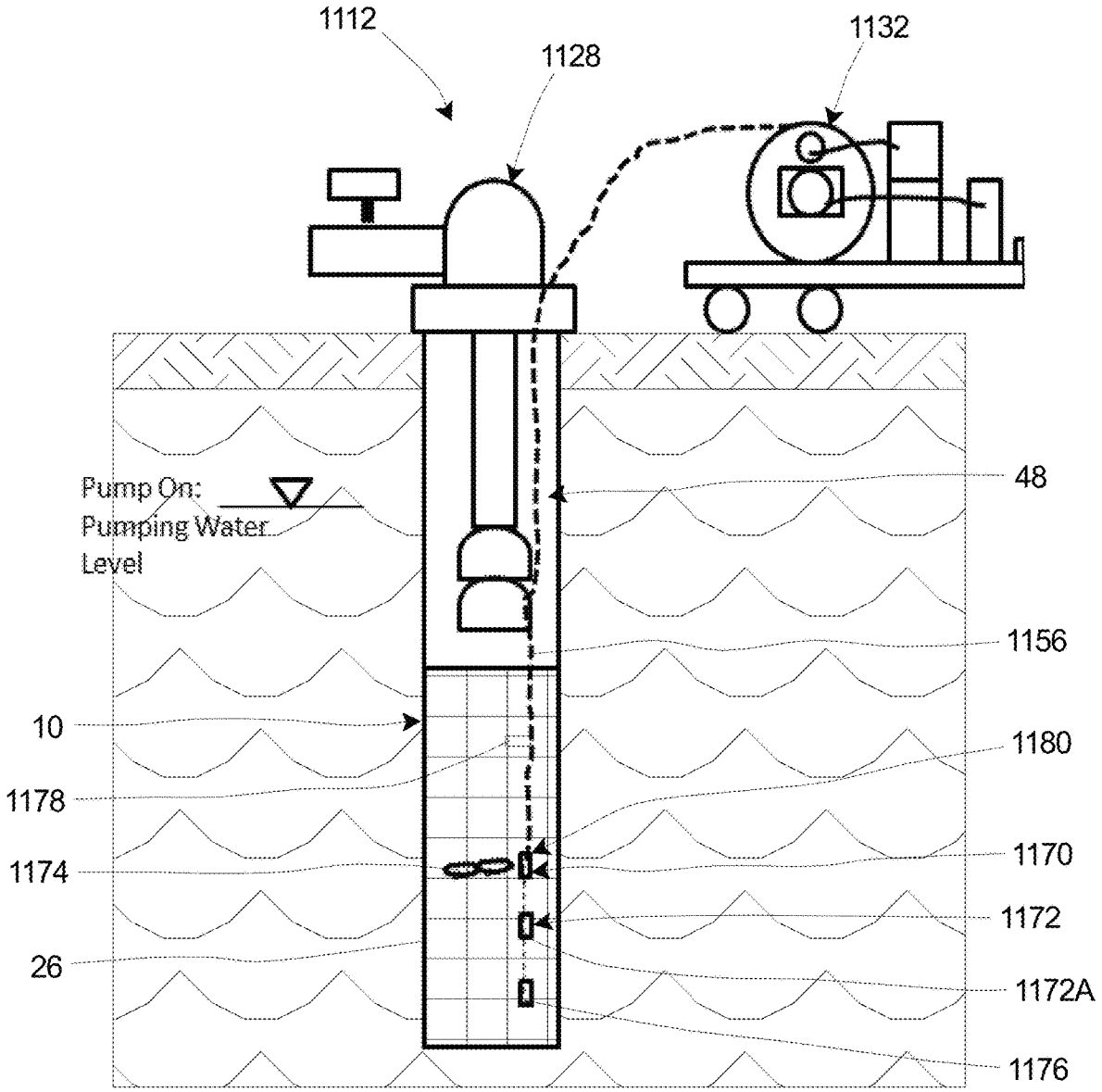
FIG. 11 is a simplified schematic illustration of the groundwater production well and yet another embodiment of the water sampling assembly.

Fourth Embodiment—Miniaturized, Flexible, Multilevel (Multi Port) Tracer Injection System for Use Inside Pumping Groundwater Production Wells and Uncased Boreholes FIG. 11 is a simplified schematic illustration of the groundwater production well 10 and yet another embodiment of the water sampling assembly 1112. In particular, FIG. 11 illustrates that the water sampling assembly 1112 again includes a primary pump assembly 1128 that is designed in a similar manner to the previous embodiments, and a control system 1132 that has certain functions in common with the previous embodiments.

However, in this embodiment, the water sampling assembly 1112 includes a flow detection assembly 1170 that is somewhat different than what was illustrated and described above. Similar to the embodiments of the flow detection assembly 1170 illustrated and described above, flow production inside of the pumping groundwater production well 10 (e.g., along the length of the well screen 26) can be measured via the flow detection assembly 1170 by means of tracer materials 1174 released into the well 10 at different depths. However, in the embodiment illustrated in FIG. 11, the flow detection assembly 1170 provides the ability to inject tracer materials 1174 into the well 10 at multiple depths simultaneously or sequentially for the purpose of making the flow profiling process more efficient.

As shown in FIG. 11, the flow detection assembly 1170 includes a plurality of tracer injection tubes 1172 (three are illustrated in FIG. 11) that are each configured to be filled with fluorescent tracer material 1174, e.g., NSF 60. Additionally, each injection tube 1172 includes an injection valve 1176 (or nozzle) that is positioned at or near the bottom 1172A of the injection tube 1172. Notably, the injection valves 1176 are all positioned at different depths within the well 10 such that fluid flow within the well 10 can be determined at multiple depths at any given time, and with a single trip into the well 10. Further, the multilevel injection system of the flow detection assembly 1170 includes the plurality of injection tubes 1172 being jacketed or sheathed accordingly within a single flexible polymer and/or braided stainless steel jacket 1156 that conjoins them together such that all of the injection tubes 1172 together behave as a single unit, i.e. a conjoined system 1180, as it is placed into and withdrawn from a groundwater production well 10. Each injection tube 1172 is of a different length where the termination of each injection tube 1172 ends with the injection valve 1176 or nozzle. The injection valve 1176 can be spring-loaded to a resistance pressure such that it will not open unless it is pneumatically actuated from a remote source, i.e. via the control system 1132, with enough pressure to depress the spring such that the injection valve 1176 will release the tracer material 1174 under pressure from the tracer injection tube 1172.

It is appreciated that the flow detection assembly 1170 can include any desired number of tracer injection tubes 1172. For example, as shown in FIG. 11, the flow detection assembly 1170 includes three injection tubes 1172. Alternatively, the flow detection assembly 1170 can include greater than three or fewer than three injection tubes 1172. It is further appreciated that the greater the number of injection tubes 1172, the more depths at which flow can be detected substantially simultaneously. However, the greater number of injection tubes 1172 also leads to an overall larger conjoined system 1180, which can impact the ability to quickly and easily be moved into and out of the well 10.

For the purpose of simultaneous injections, the injection valves 1176 can be placed at any separation distance from one another, but in some embodiments, it can be desired that the injection valves 1176 are separated from one another by between approximately ten and twenty feet. Therefore, in a production well 10 with eight tracer flow meter injection points, eight injection tubes 1172, each of which can be ten to twenty feet longer than the next, releases tracer material 1174 either simultaneously or sequentially from each depth without having to move a single tracer injection valve 1176 from one depth to the next during the survey.

Alternatively, in certain applications, the number of desired injection points can be greater than the number of injection tubes 1172 and corresponding injection valves 1176. For example, if there are eight injection tubes 1172 and corresponding injection valves 1176, and sixteen desired injection points, then there are twice as many desired injection points as there are injection tubes 1172 and injection valves 1176. In such configuration, where all of the injection valves 1176 and injection points are the same vertical distance from one to the next, then there are a maximum of two positions for each injection valve 1176. The technical efficiency benefit of course is that there are a total of two depth settings for the entire conjoined system 1180, i.e. the entire conjoined injection tubing bundle—that being a first position and then a second position that together include all of the desired injection points inside the well 10.

Still alternatively, in yet another potential application, most of the desired injection points can be on a preset spacing inside the well 10, as stated before, that being ten or twenty foot centers. However, as a result of changes in geology alongside the well 10 and spacing of the well screen 26 interval that does not coincide with the set spacing of the injection valves 1176 in the conjoined system 1180, more than one movement of the entire conjoined system 1180 can be required, and likely more than two. However, the number of total movements of the entire conjoined system 1180 still will have been dramatically reduced for the purpose of significant time-efficiency in performing the flow survey. The other benefit is technical in that there is minimal movement of the counter mechanism. Being that most counters experience a cumulative error with increased movement over time during the survey, the goal is to minimize the total number of incremental moves of the counter wheel or other type of counter mechanism.

In performing the flow survey, the computational portion comprises monitoring the velocity of each tracer 1174 injection from the release point to an up-hole tracer detector 1178, e.g., a fluorometer; the return indicator being represented by and defined as a concentration versus time plot. Each sequential depth pair of peak returns is then used within the Continuity Equation to determine the velocity of groundwater 14 moving between each pair of injection points inside the well 10. When the velocity of the groundwater 14 between the two injection points is multiplied by the cross-sectional area of the well 10 or borehole, the cumulative volume that is moving past the shallower of the two consecutive points (or pair) is defined. When the cumulative volume from injection point 2 is subtracted from the cumulative volume from injection point 1, the incremental or zonal volume of groundwater 14 flowing into the pumping well 10 between injection points 1 and 2 is defined. The calculation is repeated for each sequential pair of injection points along the length of the well screen 26—for example between 1 and 2, 2 and 3, 3 and 4, and so on. Once all of the zonal contributions are defined, a zonal plot of flow contribution along the entire length of the well screen 26 can be produced.

Figure 12:
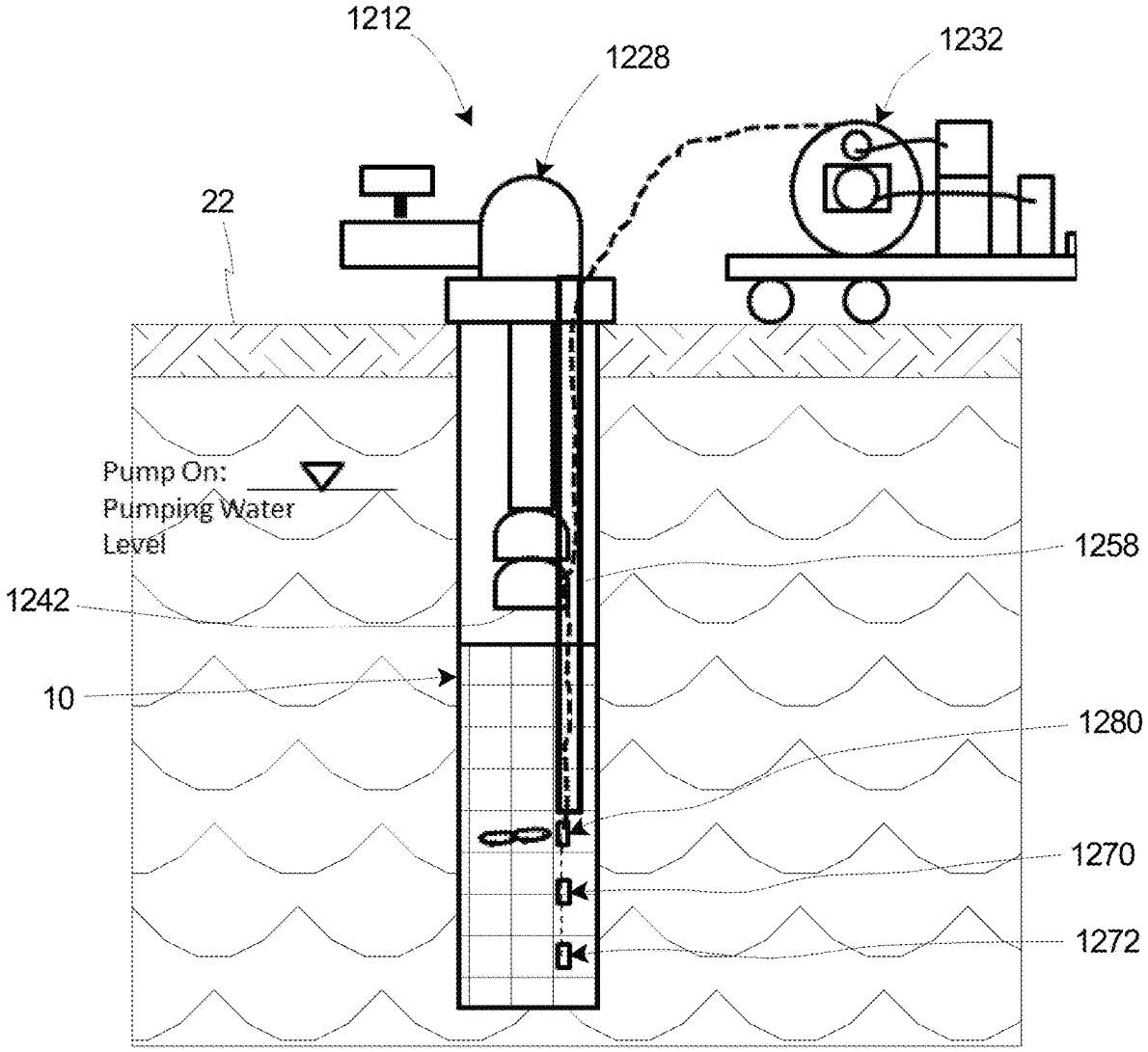
FIG. 12 is a simplified schematic illustration of the groundwater production well and another embodiment of the water sampling assembly.

FIG. 12 is a simplified schematic illustration of the groundwater production well 10 and another embodiment of the water sampling assembly 1212. As shown, the water sampling assembly 1212 is substantially similar to the water sampling assembly 1112 illustrated and described above in relation to FIG. 11. For example, the water sampling assembly 1212 again includes a primary pump assembly 1228, a flow detection assembly 1270 and a control system 1232 that are substantially similar to the corresponding components illustrated and described above.

However, in this embodiment, the groundwater well 10 further includes an access pipe 1258 for purposes of enabling the conjoined system 1280 of the plurality of injection tubes 1272 of the flow detection assembly 1270 to be installed within the groundwater well 10 and positioned below the primary pump 1228, i.e. without the need for removing the primary pump 1228 from the well 10. In particular, in cases where the annulus 48 (illustrated in FIG. 11) is too small and the conjoined system 1280 cannot pass the pump 1228 and/or pump collars within the naturally occurring annulus 48, the well owner can remove the primary pump 1228 from the well 10 and install an access pipe 1258 that extends from the surface 22 to some distance past the pump intake 1242 at depth.

Figure 13:
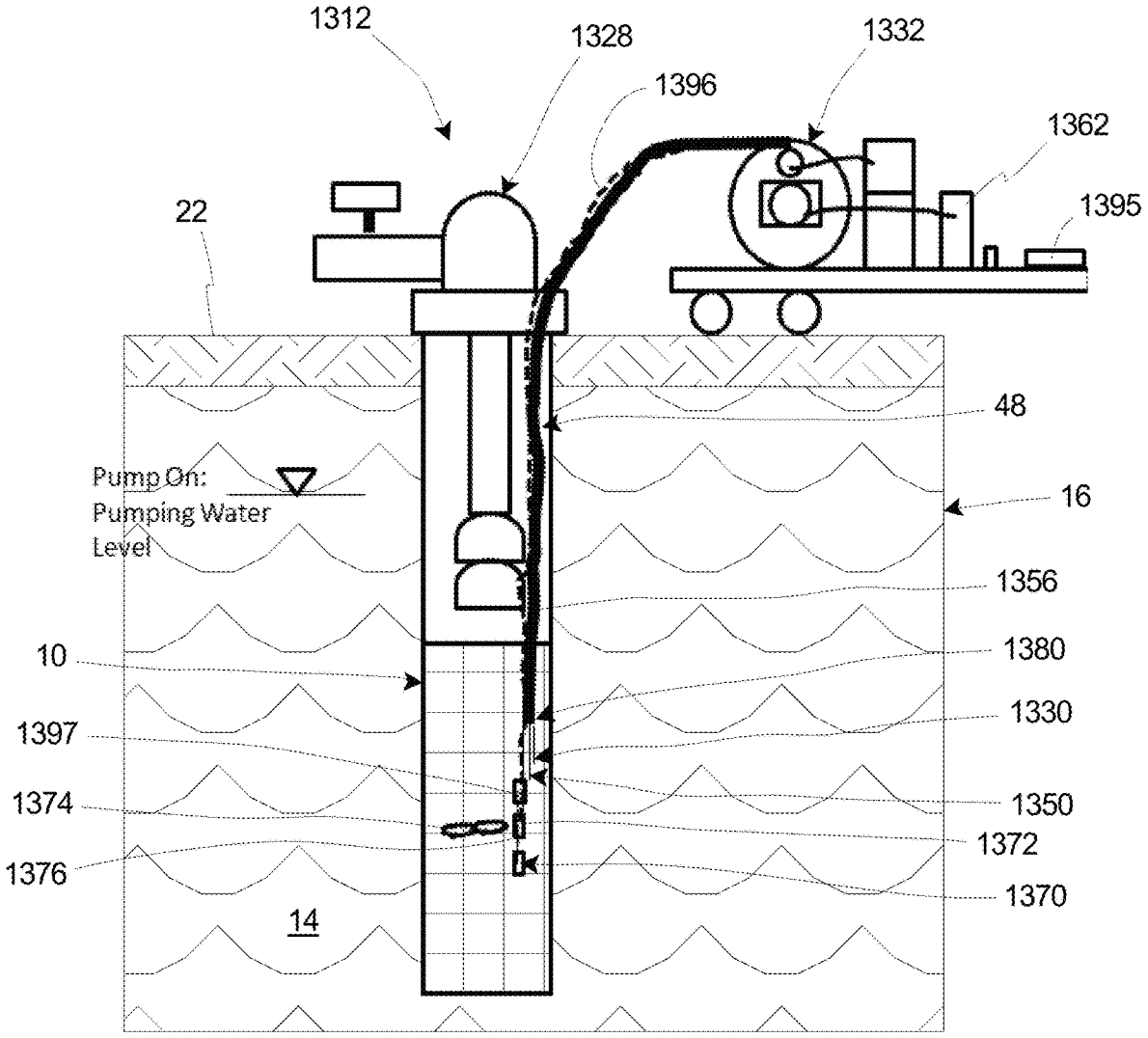
FIG. 13 is a simplified schematic illustration of the groundwater production well and still another embodiment of the water sampling assembly.

Fifth Embodiment—Conjoined Miniaturized, Flexible Multi Port Bailer and Miniaturized, Flexible Ambient Tracer Injection System for Non-Pumping Groundwater Production Wells (Including Use Inside Pumping Wells) and Uncased Boreholes FIG. 13 is a simplified schematic illustration of the groundwater production well 10 and still another embodiment of the water sampling assembly 1312. As illustrated in this embodiment, the water sampling assembly 1312 is somewhat similar to the embodiment illustrated and described above in relation to FIG. 4. For example, the water sampling assembly 1312 again includes a primary pump assembly 1328 and a water sampler 1330 (i.e. a miniaturized multi-tube, multi-valve, and multilevel bailer) that are similar in design and function to the embodiments described in relation to FIG. 4, and a control system 1332 that performs the same basic functions with regard to such components in the related embodiments. More particularly, in certain embodiments, the preferred method of operation of the multilevel bailer 1330 is again by means of a compressed gas source 1362 that can be channeled to the individual sampling tubes 1350 by way of the surface-based pneumatic control system 1332. The channeling of the compressed gas 1362 is again accomplished through the use of multiple pressure gauges and control valves, each gauge/valve pair being assigned and connected to one of the individual sampling tubes 1350 inside an exterior sheath or jacket 1356.

However, in this embodiment, the water sampling assembly 1312 further includes a flow detection assembly 1370 that is different than what has been illustrated and described herein above. As provided herein, the flow detection assembly 1370 is uniquely configured to provide accurate and timely flow calculations relating primarily to the ambient flow of the groundwater 14 within the subsurface environment 16 (although the flow detection assembly 1370 can also be used for dynamic flow detection). Additionally, the control system 1332 includes additional components and features in order to effectively control the operation of the flow detection assembly 1370.

The flow detection assembly 1370, as introduced in FIG. 13, is configured to overcome the various drawbacks experienced by previous technologies. Additionally, as with the previous embodiments, the water sampling assembly 1312 is again configured to relatively quickly, inexpensively and accurately identify and locate the source of volatile organic contaminants as well as inorganic contaminants from inside groundwater production wells.

In particular, this embodiment of the water sampling assembly 1312 again includes a conjoined system 1380 of the water sampler 1330 and the flow detection assembly 1370. For example, all of the sampling tubes 1350 of the water sampler 1330 and the in-well portion of the flow detection assembly 1370 are sheathed within a single flexible polymer and/or braided stainless steel jacket 1356 that conjoins all such components together into a single unit, i.e. into the conjoined system 1380. With such design, the water sampling assembly 1312 is able to detect flow of the groundwater 14 at various depths and collect depth-dependent water quality samples from the same depths as the flow measurements in the same trip into and out of the well 10. As noted above, minimizing the number of trips of the water sampling assembly 1312 into and out of the well 10 provides tremendous advantages in terms of time, cost and accuracy of the groundwater sampling program. Additionally, similar to previous embodiments described herein, another advantage of the present technology is that the conjoined system 1380, i.e. the conjoined water sampler 1330 and flow detection assembly 1370, is small enough in diameter to be inserted into the well 10 in most situations via the annulus 48 without the need to remove the primary pump 1328 and other inner workings of the well 10 prior to the commencement of the flow meter and groundwater sampling survey. As with the previous embodiments, the conjoined system 1380 is also flexible enough to articulate and radius through angled pathways and around protrusions, e.g., from the pump 1328, and into the well 10.

The flow data derived under ambient, non-pumping conditions is important for various reasons. When wells are shut down for repairs or are put out of service due to contaminant discharges that exceed the maximum allowable concentrations (MCLs) the wells can be off (or non-pumping) for many days, weeks, months or even years. During this time, contaminants entering the well under hydraulic pressure from the surrounding aquifer can be transported vertically through the well conduit and exit along the well screen into a portion of an aquifer that manifests a lower pressure hydraulic zone. This type of phenomenon is not happening on a small scale, but is potentially occurring in thousands of wells throughout regions that depend heavily or solely on groundwater. Moreover, the problem could be occurring throughout thousands of agricultural wells where the wells are used on a seasonal basis—with some wells not being used for months until the next growing season. These non-pumping agricultural wells can serve as conduits for pesticides, nitrates and other types of fertilizers whose chemistry is toxic to humans and animals when chronically (or in some cases acutely) ingested through drinking water supplies. The sum total combination of municipal, agricultural and all of the other types of groundwater wells that are acting as contaminant conduits is great. However, the cost of removing a pump to perform a flow meter survey serves as a cost obstacle to obtaining access into the well in order to define the contaminant conveyance problem and to derive a solution. The invention presented herein provides a means of solving this ubiquitous problem.

The design of the flow detection assembly 1370 can be varied. In certain embodiments, as provided herein, the flow detection assembly 1370 portion of the invention is described as a tracer pulse ambient flow meter (TPAF) that specifically uses laser-induced fluorescence (LIF) to track vertical (and even horizontal) in-well water flow velocities. More particularly, the present invention uses laser beam technology (at the surface 22), i.e. a laser 1395 in combination with fiber optic cables 1396 with underwater, end member laser emitters and photon receivers 1397 (based on the individual functions of these components, they are sometimes referred to herein simply as "laser emitters" or "photon receivers") along the length and terminus of the fiber optic cables 1396; a dye injection tube 1372 placed anywhere along the length of the fiber optic emitters and receivers 1397; and fluorescent dye used as a tracer 1374. These components are combined together as a down-hole and/or in-well ambient (static) flow meter, which is conjoined with a depth-dependent in-well water sampler 1330 to form the conjoined system 1380.

Thus, as noted, the desired flow velocities can be detected at substantially the same time (i.e. simultaneously or just before or just after) as depth dependent in-well water samples are being collected from the desired flow measurement depths using the pneumatically (and/or electronically) controlled multilevel bailer 1330.

It is appreciated that placement of the dye injection tube 1372 and the corresponding injection valve 1376 at its terminus can just as easily be placed above or below all of the laser emitters and photon receivers 1397. In a typical application, anywhere from two to eight laser emitters and photon receivers 1397 are placed along the length of a fiber optic cable 1396 (although any number of these components can be used). Each pair of fiber optic emitters and receivers 1397 are always coupled together about the same depth, and are preferably integrated into a single protective housing.

The portion of the control system 1332 that functions as a signal processing unit 1632A (illustrated in FIG. 16) for streaming photon return is located at the surface 22. The signal processing unit 1632A contains the laser 1395, which emits a laser beam of compatible intensity and wavelength to cause the down-hole injected tracer dye 1374 to fluoresce. In certain embodiments of the present invention, the laser 1395 produces a wavelength emission between 540 to 580 nanometers (green light) which is ideal for fluorescing rhodamine red FWT 50, which may be used as the tracer 1374. However, any suitable combination of laser emission intensity and wavelength and compatible dye can be used for the invention. In some embodiments, the laser 1395 can be coupled with a set of mirrors (not shown) in the signal processing unit 1632A that functions as a beam splitter/multiplier, which allows the laser beam to be split into multiple beams of light. Thus, from a single laser beam, multiple light beams can be formed. If necessary, the signal processing unit 1632A can include more than one laser as an increasing number of light emission channels are required. Each laser-beam multiple inside the signal processing unit 1632A has an exit point to the outside of a housing 1632B (illustrated in FIG. 16) through a light-tight fiber optic connector 1632C (illustrated in FIG. 16). The ground-surface end for each fiber optic cable 1396 is connected to the exterior exit points of the housing 1632B. The laser light is transmitted through the exterior portals and into the optical fibers 1396. The light in each fiber optic cable 1396 travels to the coupled laser emitter 1397 where the light is released into the surrounding well 10 or borehole water. A pulse of tracer dye 1374 in close proximity (and at a known fixed distance) to the string of laser emitters 1397 is released using the dye injection system, i.e. the injection valve 1376, the injection of which is controlled from the surface 22 by various means, such as described above.

The full operation of the flow detection assembly 1370 will be described in greater detail herein below.

Figure 14:
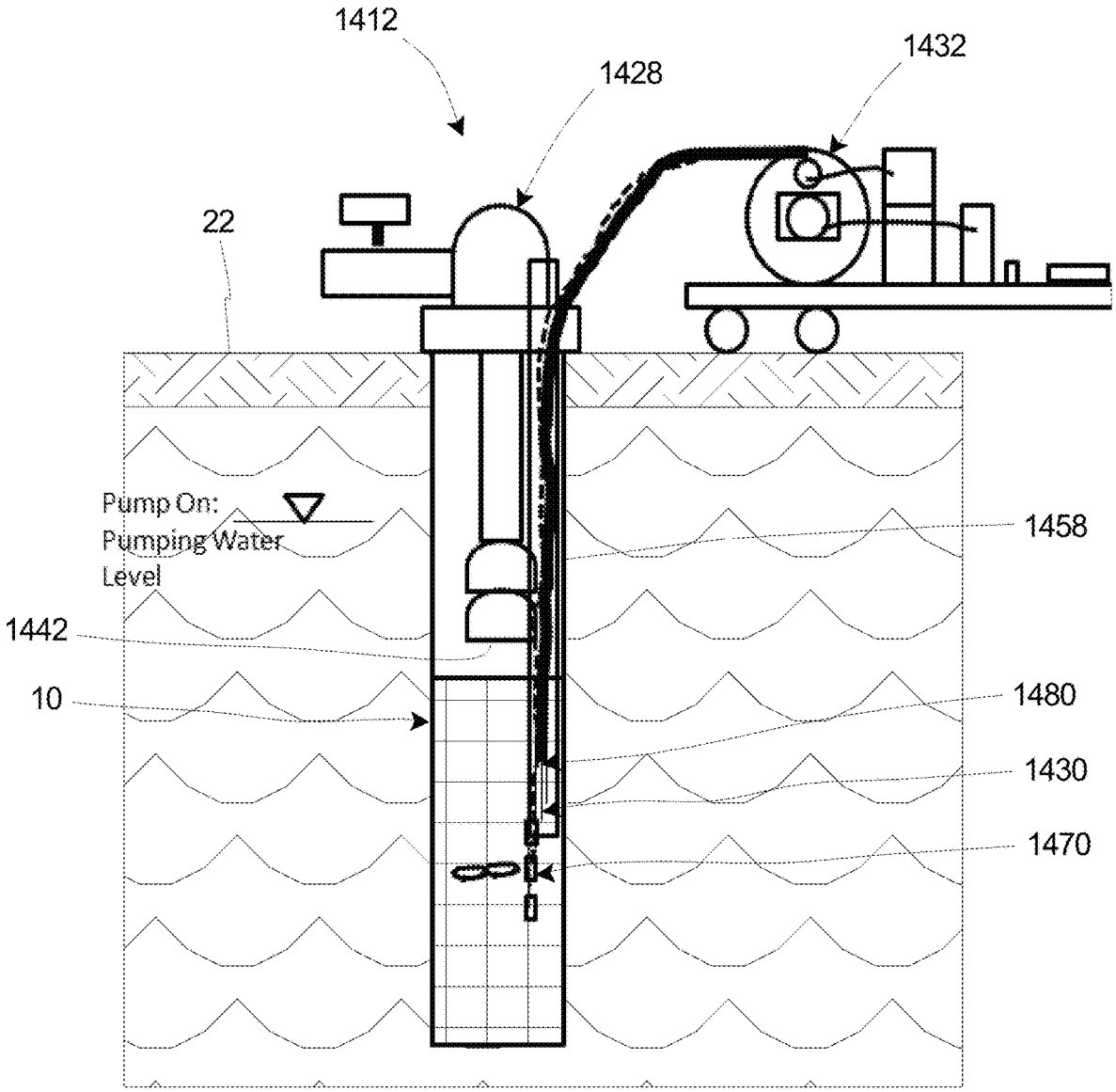
FIG. 14 is a simplified schematic illustration of the groundwater production well and another embodiment of the water sampling assembly.

FIG. 14 is a simplified schematic illustration of the groundwater production well 10 and another embodiment of the water sampling assembly 1412. As shown, the water sampling assembly 1412 is substantially similar to the water sampling assembly 1312 illustrated and described in relation to FIG. 13. For example, the water sampling assembly 1412 again includes a primary pump assembly 1428, a water sampler 1430, a flow detection assembly 1470 and a control system 1432 that are substantially similar to the corresponding components in FIG. 13.

However, in this embodiment, the groundwater well 10 further includes an access pipe 1458 for purposes of enabling the conjoined system 1480 of the water sampler 1430 and the flow detection assembly 1470 to be installed within the groundwater well 10 and positioned below the primary pump 1428, i.e. without the need for removing the primary pump 1428 from the well 10. In particular, in cases where the annulus 48 (illustrated in FIG. 13) is too small and the conjoined system 1480 cannot pass the pump 1428 and/or pump collars within the naturally occurring annulus 48, the well owner can remove the primary pump 1428 from the well 10 and install an access pipe 1458 that extends from the surface 22 to some distance past the pump intake 1442 at depth. Additionally, there can also be a significant cost advantage if a dynamic flow survey is to be performed following the ambient survey in that a rented test pump from a local pump and well service company is not required. The cost of using a test pump for a follow-on dynamic survey is typically equal to or greater in cost than removal and reinsertion of the primary pump 1428 due to the cost of installing and removing the test pump as well as the cost to the operator for labor-hours to operate the pump that belongs to the pump service company.

With respect to the embodiments illustrated in both FIG. 13 and FIG. 14, and similar to the previous embodiments, to prepare the conjoined system 1380, 1480 for insertion into the well 10, there can be a string of weights (preferably stainless steel metal) that is attached to the bottom of the water sampler 1330, 1430 and/or the flow detection assembly 1370, 1470. The weighted system can be inserted through the annulus 48 or access pipe 1458 into the well 10. The weights again provide vertical stabilization and inertia for the conjoined system 1380, 1480 within the turbulent well 10.

It is understood that the proposed tracer pulse ambient flow meter (TPAF) of the present invention can just as easily be used inside of a pumping well—and for that matter also inside an injecting well. The key advantage of the TPAF over previous technologies for a pumping well is that the velocity measurement is time-based. More specifically, the TPAF system responds to fluorescence down-hole (in-well) as opposed to being surface-response dependent. This particular benefit represents a substantial time-based measurement improvement over the previous technologies, as an increased distance between the tracer release point and tracer measurement point can result in increasing measurement errors. Since in-well velocity measurements are used to calculate the average bulk flow rate at any given depth inside the well, small errors in the velocity measurement can lead to large errors in estimating cumulative flow. To help alleviate such issues, as noted, the TPAF invention provides in-well velocity measurement data inside the well as opposed to at the ground surface.

Another key technological advantage over existing conventional ambient flow meter technologies is the ability to make a direct flow measurement through the complete cross-sectional surface area of the well 10 at any given location. In other words, a direct flow measurement can be made via a planar transect of the well 10 at any given depth location for the purpose of deriving the averaged cumulative bulk flow rate flowing through the transect. Therefore, the technology is ideal for large diameter groundwater production wells, as well as injection and aquifer storage and recovery wells, that typically measure eight to twenty inches in diameter (or larger).

However, it is further understood that the technology included in the present invention can also be used in smaller diameter wells. As provided herein, the centralization approach that has been used in previous systems is not necessary with the present invention since it uses sideways, multiple radial injection points for the tracer 1374 at any given depth location and at any off-centered location inside the well.

Figure 15A:
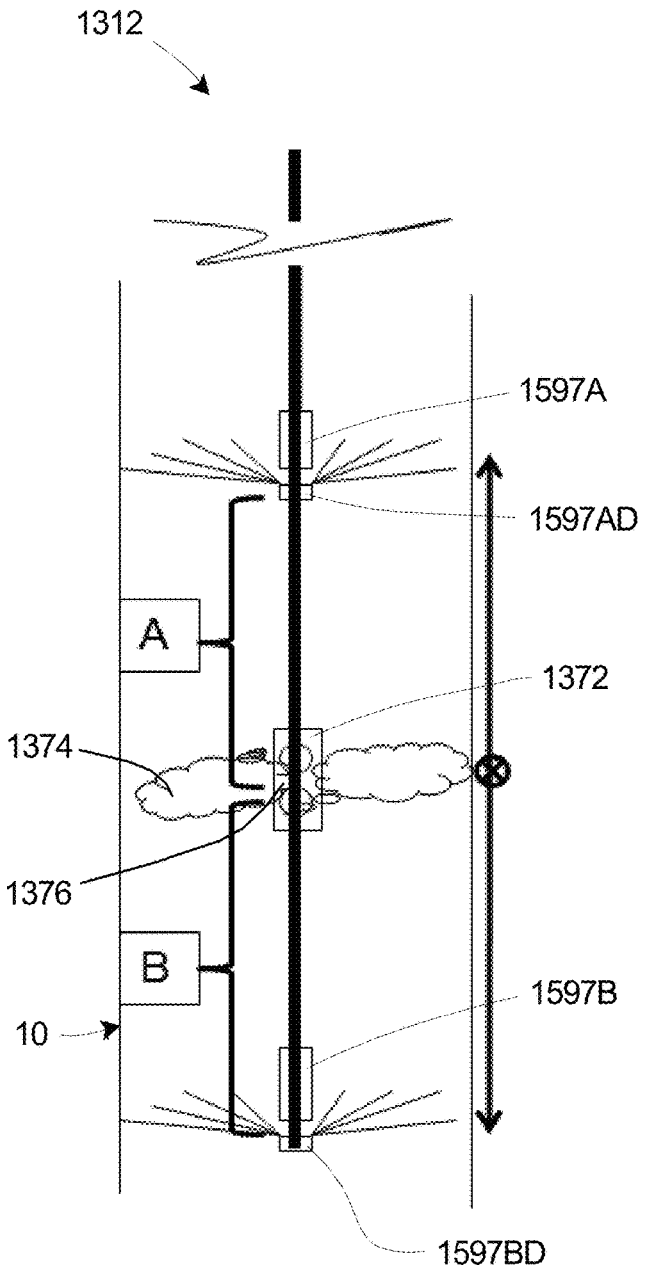
FIG. 15A is a simplified schematic illustration demonstrating an example of the operation of a portion of the water sampling assembly.

FIG. 15A is a simplified schematic illustration demonstrating an example of the operation of a portion of the water sampling assembly 1312. In particular, FIG. 15A illustrates the tracer tubing 1372 and injection valve 1376 for releasing the tracer materials 1374 within the well 10, a first laser emitter and photon receiver 1597A that is positioned above the injection valve 1376, and a second laser emitter and photon receiver 1597B that is positioned below the injection valve 1376.

Figure 15B:
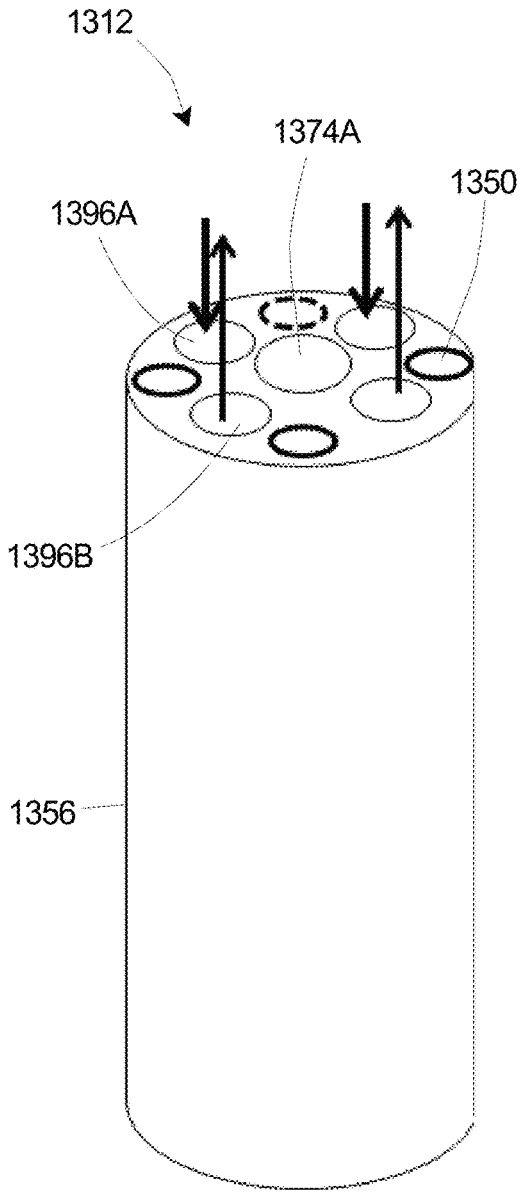
FIG. 15B is a simplified schematic illustration demonstrating another example of the operation of another portion of the water sampling assembly.

Additionally, FIG. 15B is a simplified schematic illustration demonstrating another example of the operation of another portion of the water sampling assembly 1312. In particular, FIG. 15B illustrates an example of the positioning of the tracer injection tubing 1374A, the fiber optical cables 1396A for transmitting laser beams from the signal processing unit 1632A (illustrated in FIG. 16) to the laser emitters 1397 (illustrated in FIG. 13), the fiber optical cables 1396B for transmitting the fluorescent photon stream from the photon receivers 1397 to the signal processing unit 1632A, and the bailer tubing 1350 of the water sampler 1330 (illustrated in FIG. 13), i.e. the multilevel bailer, within the jacket 1356.

Figure 16:
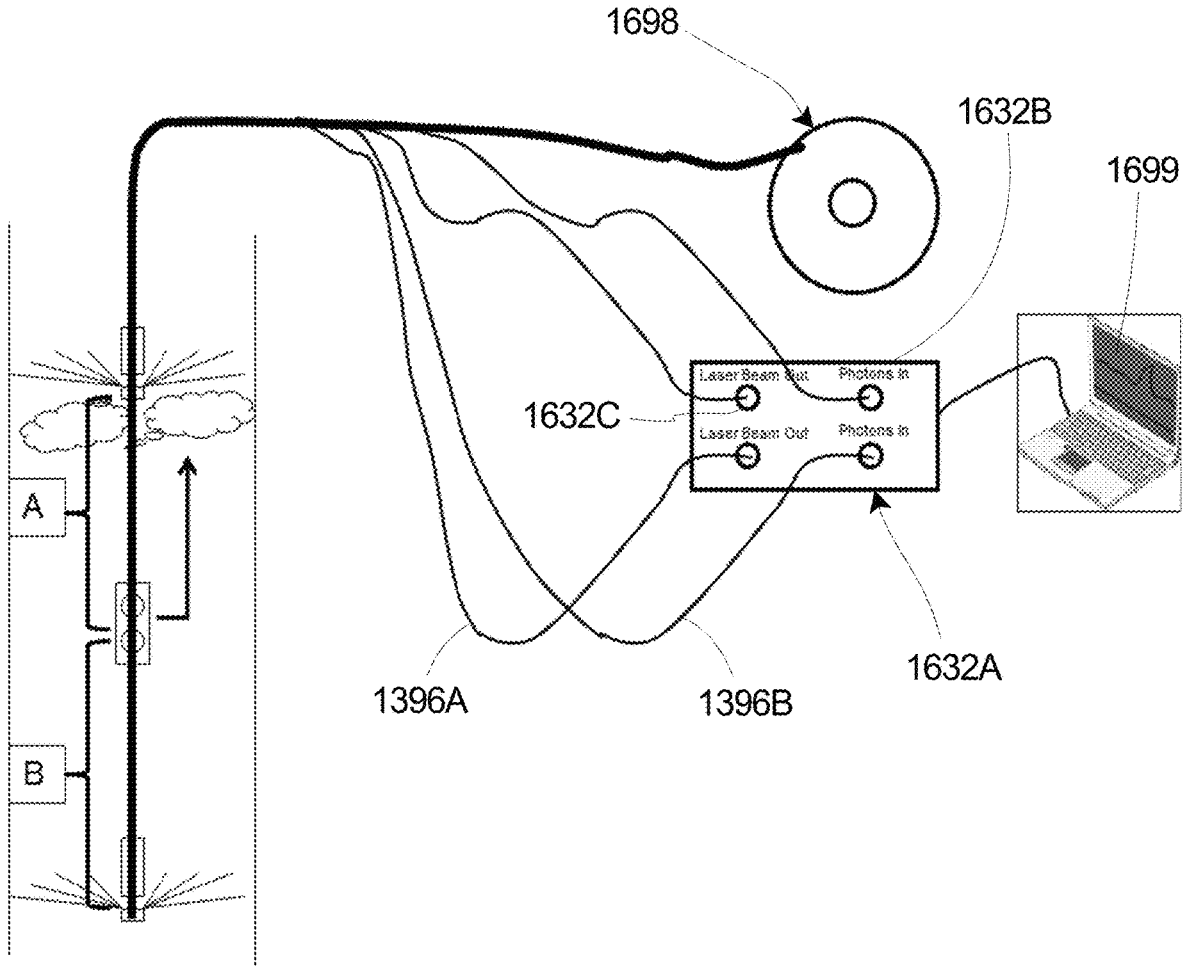
FIG. 16 is a simplified schematic illustration demonstrating the operation of another portion of the water sampling assembly.

Further, FIG. 16 is a simplified schematic illustration demonstrating the operation of another portion of the water sampling assembly 1312. In particular, FIG. 16 illustrates the design and functioning of additional aspects and components on the control system 1332, i.e. of the signal processing unit 1632A.

Figure 17A:
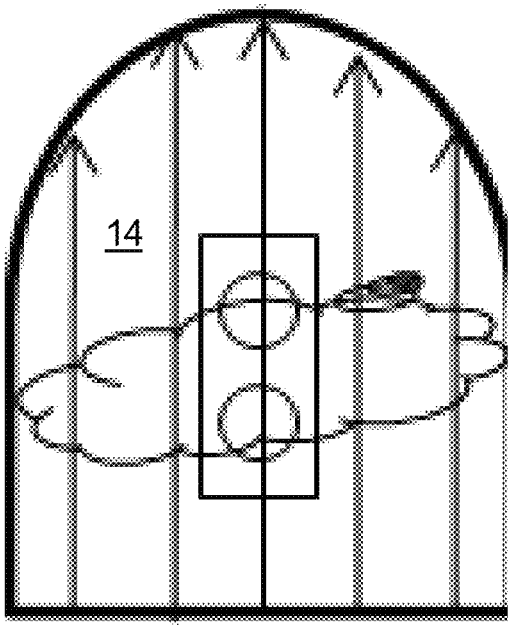
FIGS. 17A and 17B are simplified schematic illustrations demonstrating potential flow patterns of groundwater within the groundwater production well.
Figure 17B:
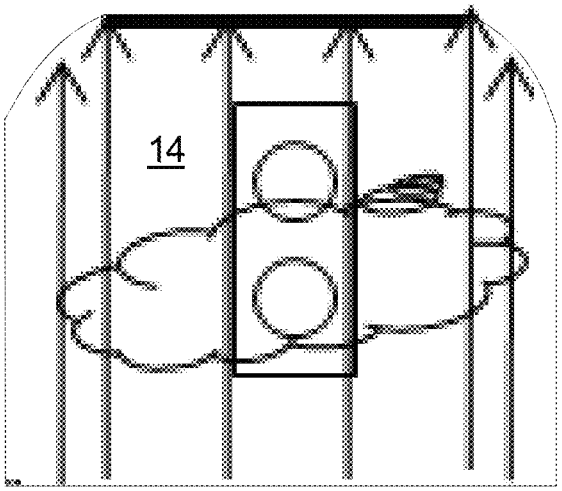

Still further, FIGS. 17A and 17B are simplified schematic illustrations demonstrating potential flow patterns of groundwater 14 within the groundwater production well 10. For example, as shown in FIG. 17A, groundwater flow velocities inside a pipe are typically parabolic in distribution under laminar flow. Alternatively, as shown in FIG. 17B, the groundwater flow velocities under non-pumping turbulent flow can be in the form of a truncated velocity parabola.

Examining FIG. 15A and FIG. 16 in conjunction with one another, the operation of the flow detection assembly 1370 can be better and more fully appreciated.

As with previous embodiments that utilized a flow detection assembly, in the present invention, the means of tracer dye 1374 injection is controlled with an injection motor and pump coupled with a pneumatic solenoid and switching valve (see e.g., FIG. 6 and the related discussion). An electronic control box interface with the tracer injection system 1698 allows the operator to control the length of time that the tracer dye 1374 is injected down in the well water. The use of the electronically-controlled tracer dye injection allows for more precise down-hole velocity measurements. Simultaneously with the tracer dye injection, the time of tracer dye injection is recorded and the operator waits for a signal return to be indicated on an analog laptop/computer display 1699. The flow direction of the tracer dye 1374 in the non-pumping well 10 will determine which light transmission channel(s), photon receivers 1397 will respond (i.e. the photon receivers 1597A above the tracer dye release point, or the photon receivers 1597B below the tracer dye release point). If the flow gradient inside the well 10 is upward, then the light channel (photon) receivers 1597A above the injection valve 1376 will respond.

Conversely, if the groundwater flow gradient inside the well 10 is downward, then the light channel (photon) receivers 1597B below the dye injection valve 1376 will respond. If the flow direction inside the well 10 is neither down nor up, but sideways across the well 10 itself, then neither the light channel photon receivers 1597A, 1597B above or below the dye injection valve 1376 will respond. In this case, the absence of response is typically indicative of groundwater 14 (illustrated in FIG. 13) exiting the well 10 into the surrounding aquifer—a convergence zone for groundwater 14 egress from the well 10 into a surrounding lower pressure aquifer zone. Thus, the directional ambient flow data inside the well 10 can be used in a bracketing method whereby the zone of egress can be defined. On a quantitative basis, the Continuity Equation can be used to define how much groundwater 14 is entering the well 10 and leaving the well 10 on a zone by zone basis, anywhere inside the well 10.

It is appreciated that is certain embodiments, the first laser emitter and photon receiver 1597A is positioned a substantially equal distance above the injection valve 1376 as the second laser emitter and photon receiver 1597B is positioned below the injection valve 1376. Alternatively, the first laser emitter and photon receiver 1597A can be positioned a different distance above the injection valve 1376 as compared to the distance that the second laser emitter and photon receiver 1597B is positioned below the injection valve 1376.

As part of a detailed explanation of the apparatus utilized for the TPAF portion of the invention (see e.g., FIG. 16), each fiber optic cable 1396A that exits from the signal processing unit 1632A also has a paired receiving cable 13968 for transmitting photons back to the signal processing unit 1632A from the fluorescing dye. As the dye fluoresces, a stream of photons is released from collapsing fluorescent energy states. Some of the scattered photons travel in the direction of the photon receiver 1597A, 15978 that is embedded directly next to the light emitting fiber terminus. Photons enter the return fiber and travel back to the signal processing unit 1632A where the signal is amplified by photo multiplier tubes (or PMTs). Photo diodes then convert the light energy to electrical energy, and can be converted to a corresponding voltage or current. A hardware-software interface within the signal processing unit 1632A converts the electrical signal to an analog display format that can be monitored on the computer screen 1699. The analog display can be configured to read as optical units or as dye concentration. The software interface also includes a time marker that allows the operator to designate the start time of the test on the computer screen 1699 and is time-logged accordingly against signal return.

It is understood that the combination of the light intensity of the laser 1395 (illustrated in FIG. 13) and the type of fiber optic cable 1396A, 1396B used can be an important aspect for the proper functioning of the present invention. A wide array of laser beam intensity choices are available for the light transmission down hole to the fiber optic emission terminus. However, the selection is more limited for the return fibers 1396B that relay the fluorescent-photonic light signal back to the signal processing unit 1632A. Being that there is signal loss from the light emission into the surrounding well water and even weaker signal strength from the photonic emission resulting from the fluorescing tracer dye 1374, the fiber core area of the signal return fiber 1396B has to have a large enough core diameter open surface area at the down-hole cable terminus to receive enough photons that can be translated into a detectable return signal. For this reason, in certain embodiments of the invention, the fiber optic core diameter for the return fiber 1396B is a minimum of 470 microns (470 u) and paired with a 561 nanometer 25 milli-watt laser (25 mW).

Alternatively, other combinations can be used. For example, smaller diameter fiber optic cable cores can be used provided that higher intensity lasers are used in combination with this approach. The combination of the laser's wavelength emission and mW power has to be properly coupled with the excitation band that makes the tracer dye of choice fluoresce. For deeper depth applications and longer fibers, higher intensity lasers can be used in the 50 mW, 75 mW, 100 mW and 125 mW range and even higher.

Integral to the down-hole laser emitters 1397 is that each laser emitter 1597A above the tracer dye release point is coupled with a parabolic dish 1597AD that the laser emitter 1597A fires into. In various embodiments, the parabolic dish 1597AD is located about one-half inch from the laser emitter light exit point—although various distances can be configured. The conical light beam fires into the concave facing side of the parabolic dish 1597AD. The parabolic dish 1597AD inverts the conical beam and spreads the light both laterally and upwards into a concentric halo around the light beam emitter's housing, thus preventing any light from being spread to the area below the laser emitter 1597A. The purpose of the parabolic dish light spreader is to prevent the laser emitters 1597A above the tracer dye injection release point from firing directly towards the dye injection valve 1376. Due to the light beam's intensity, the light beam can travel through the groundwater 14 at a significant distance from the laser emitter 1597A and trigger a fluorescent response from the dye well before it arrives at the photonic receiver 1597A which is embedded next to the light emitter 1597A. The excitation is of sufficient strength as to provide the photons with enough energy to instantaneously travel the entire separation distance between the injection valve 1376 and the photon receiver 1597A, therefore providing a false apparent velocity and not a true velocity measurement. By precluding this undesired result with the parabolic dish light spreader 1597AD, an accurate velocity measurement can be determined for the tracer dye 1374 to reach the horizontal plane of the laser emitter 1597A.

Somewhat similarly, laser emitters 1597B located beneath the tracer dye injection valve 1376 fire a downward conical light beam moving in a direction away from the tracer dye injection valve 1376. The conical spread of the laser light from these laser emitters 1597B is of sufficient intensity to cover the entire cross-sectional surface area of the well 10. If desired, a convex light spreader 1597BD can be placed at about a one-half inch distance below each laser beam light emitter 1597B that is located below the injection valve 1376.

As noted above, a specific centralization approach is not necessary with the present invention since it uses sideways, multiple radial injection points for the tracer 1374 at any given depth location and at any off-centered location inside the well 10. As provided herein, when the tracer 1374 is injected, the tracer 1374 is spread out over the entire cross-sectional plane of the well 10. The ambient flow gradients inside the well 10 then typically carry the tracer dye 1374 either up or down inside the well 10—passing through an upper or lower radial laser emission halo that extends across the entire cross-sectional plane of the well 10. In the case of either upward or downward groundwater 14 migration under non-pumping conditions (ambient), the tracer 1374 shadows the entire three-dimensional transect of the vertical flow-front from the center of the well 10 to the boundary layer of the well 10 where groundwater 14 is in contact with the well casing, screen or borehole wall.

Since groundwater flow velocities inside a pipe are typically parabolic in distribution under laminar flow (see FIG. 17A, for example) and sometimes even form a truncated velocity parabola under non-pumping turbulent flow (see FIG. 17B, for example), the fluid moving inside the boundary layer has the slowest velocity due to the greatest frictional drag with the inside wall of the well 10, whereas the fluid moving in the center of the well 10 generally has the fastest velocity due to the least amount of frictional drag and the greatest amount of fluid shear and slip. Therefore, integration of the area under the velocity parabola for any measurement provides the most accurate estimate of average bulk flow rate through any imaginary horizontal plane of the well 10—taking into consideration the entire spectrum of fluid velocities through the well 10. First arrival times and peak arrival times for the velocity parabola can also be used provided that they are consistently used throughout the analysis.

As provided above, during operation of the water sampling assembly 1312, the groundwater sampling program often begins with descending the conjoined system 1380 to the shallowest depth first to collect water samples and to accurately detect water flow at that depth. The conjoined system 1380 is then lowered to the next deepest location and the process repeated. The process can be repeated for as many individual bailer lines contained within the apparatus.

Figure 18:
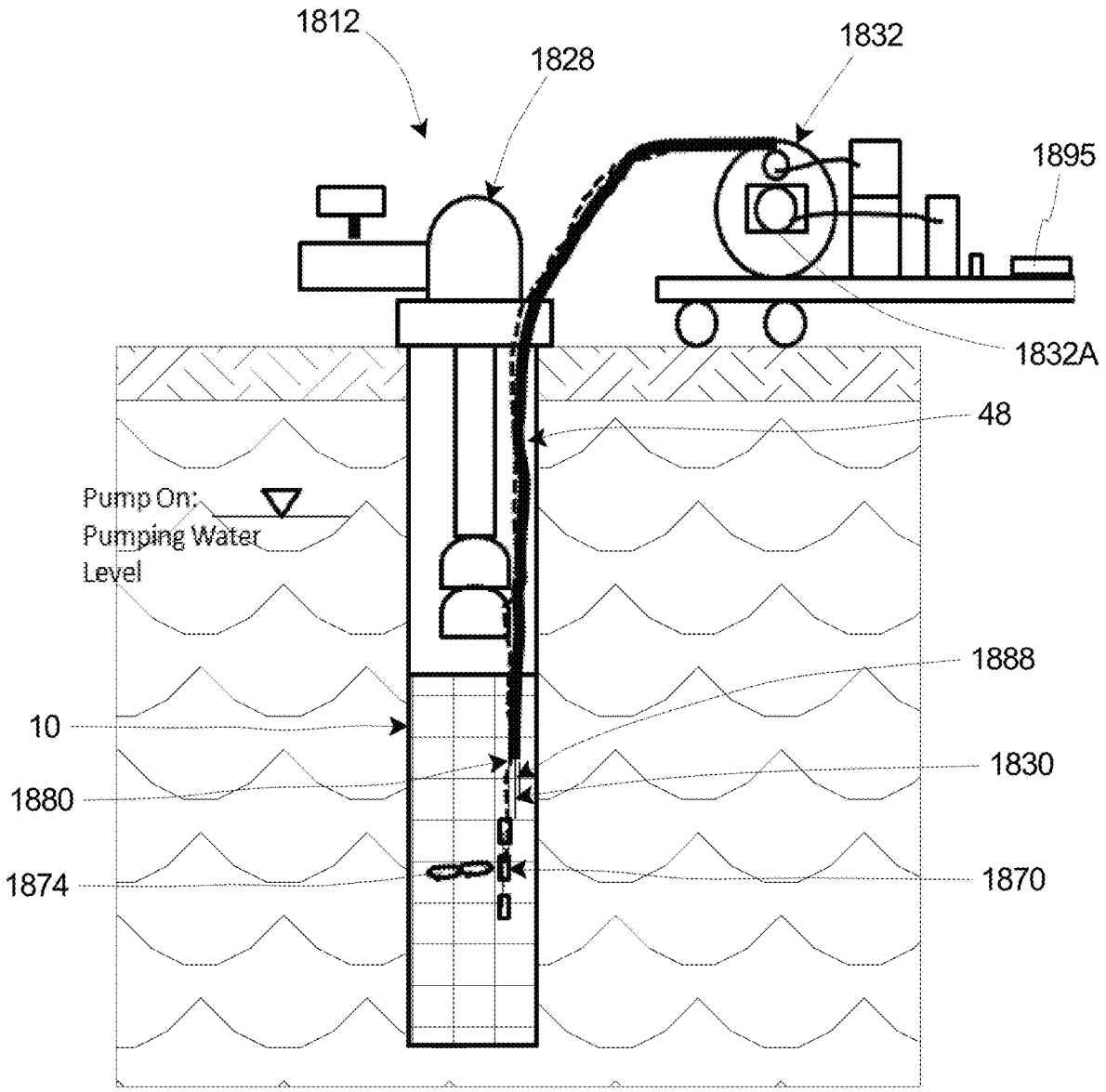
FIG. 18 is a simplified schematic illustration of the groundwater production well and yet another embodiment of the water sampling assembly.

Sixth Embodiment—Conjoined Miniaturized Sampling Pump and Miniaturized, Ambient Tracer Injection System for Use Inside Non-Pumping Groundwater Production Wells (Including Use Inside Pumping Wells) and Uncased Boreholes FIG. 18 is a simplified schematic illustration of the groundwater production well 10 and yet another embodiment of the water sampling assembly 1812. As shown, the water sampling assembly 1812 is somewhat similar to the previous embodiments illustrated and described above. More specifically, in addition to the primary pump assembly 1828, the water sampling assembly 1812 also includes a sampling pump 1888 as the water sampler 1830 that is substantially similar to the embodiment illustrated and described in relation to FIG. 7, and a flow detection assembly 1870, i.e. a tracer pulse ambient flow meter (TPAF), that is substantially similar to the embodiment illustrated and described in relation to FIG. 13 (details also shown and described in relation to FIG. 15A and FIG. 16). Additionally, the water sampling assembly 1812 further includes the control system 1832 that controls the operation of the sampling pump 1888 and the flow detection assembly 1870 in the manner as described above.

In particular, as illustrated and described in relation to FIG. 18, this embodiment of the water sampling assembly 1812 is directed toward a miniaturized, flexible, underwater, multi-point emission laser 1895 used in conjunction with fluorescent tracer dye 1874 for measuring ambient (or static) fluid flow inside of a non-pumping well that is conjoined with a miniaturized sampling pump 1888 into a conjoined system 1880 for collecting depth-dependent water quality samples from the same depths as the flow measurements and in the same trip into and out of the well. As above, this technology specifically uses laser induced fluorescence (LIF) to track vertical (and even horizontal) in-well water flow velocities and at the same time be able to collect a depth-dependent in-well water sample from any flow measurement depth either simultaneously or just before or after the flow measurement is made using the sampling pump 1888.

As provided in the preceding section above (i.e. with reference to the fifth embodiment), the proposed ambient flow meter (TPAF) provides various technological and economic advantages over prior art flow metering technology. For example, with the proposed technology of the miniaturized, flexible, underwater, multi-point emission laser 1895 conjoined with a miniaturized sampling pump 1888, separate trips into the well 10 for flow measurements and for samples retrieved are no longer required.

Figure 19:
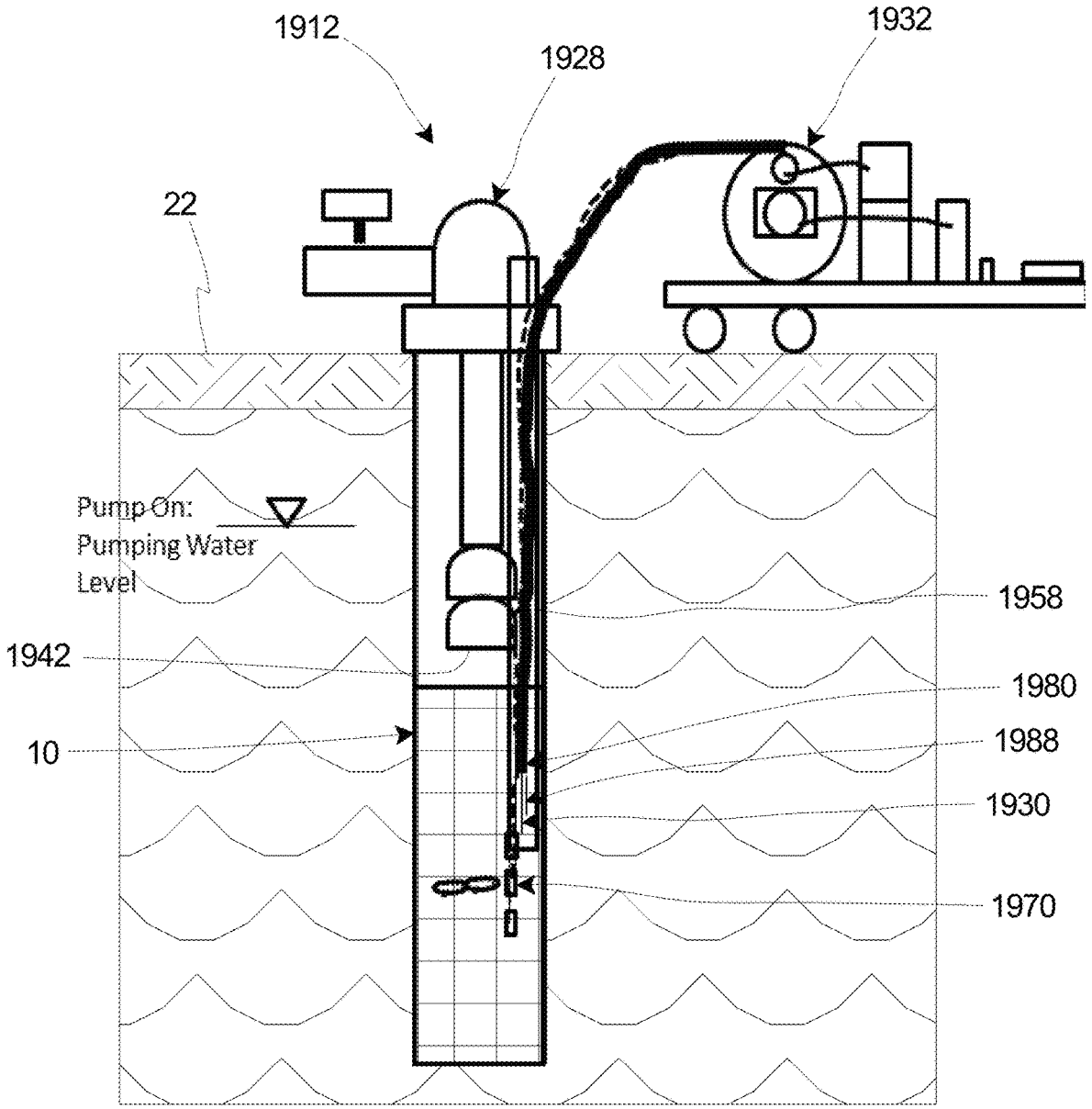
FIG. 19 is a simplified schematic illustration of the groundwater production well and still another embodiment of the water sampling assembly.

FIG. 19 is a simplified schematic illustration of the groundwater production well 10 and another embodiment of the water sampling assembly 1912. As shown, the water sampling assembly 1912 is substantially similar to the water sampling assembly 1812 illustrated and described in relation to FIG. 18. For example, the water sampling assembly 1912 again includes a primary pump assembly 1928, a water sampler 1930, i.e. a sampling pump 1988, a flow detection assembly 1970 and a control system 1932 that are substantially similar to the corresponding components in FIG. 18.

However, in this embodiment, the groundwater well 10 further includes an access pipe 1958 for purposes of enabling the conjoined system 1980 of the sampling pump 1988 and the flow detection assembly 1970 to be installed within the groundwater well 10 and positioned below the primary pump 1928, i.e. without the need for removing the primary pump 1928 from the well 10. In particular, in cases where the annulus 48 (illustrated in FIG. 18) is too small and the conjoined system 1980 cannot pass the pump 1928 and/or pump collars within the naturally occurring annulus 48, the well owner can remove the primary pump 1928 from the well 10 and install an access pipe 1958 that extends from the surface 22 to some distance past the pump intake 1942 at depth. Additionally, there can also be a significant cost advantage if a dynamic flow survey is to be performed following the ambient survey in that a rented test pump from a local pump and well service company is not required. The cost of using a test pump for a follow-on dynamic survey is typically equal to or greater in cost than removal and reinsertion of the primary pump 1928 due to the cost of installing and removing the test pump as well as the cost to the operator for labor-hours to operate the pump that belongs to the pump service company.

With respect to the embodiments illustrated in both FIG. 18 and FIG. 19, and similar to the previous embodiments, to prepare the conjoined system 1880, 1980 for insertion into the well 10, there can be a string of weights (preferably stainless steel metal) that is attached to the bottom of the sampling pump 1888, 1988 and/or the flow detection assembly 1870, 1970. The weighted system can be inserted through the annulus 48 or access pipe 1958 into the well 10. The weights again provide vertical stabilization and inertia for the conjoined system 1880, 1980 within the turbulent well 10.

Figure 20A:
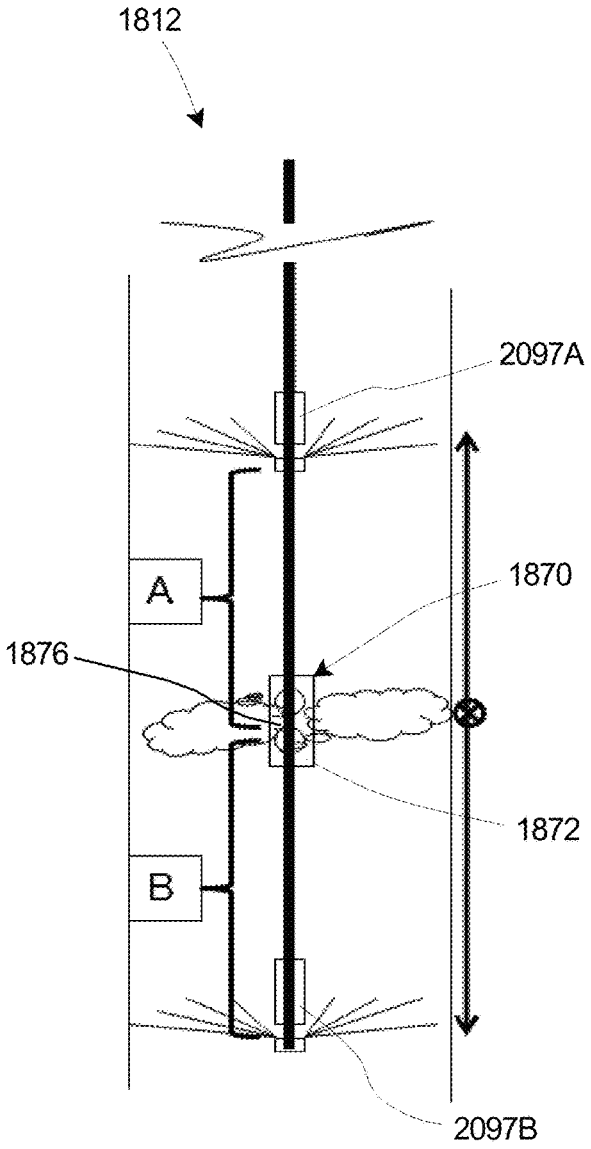
FIG. 20A is a simplified schematic illustration demonstrating one embodiment of the operation of a portion of the water sampling assembly.

FIG. 20A is a simplified schematic illustration demonstrating an example of the operation of a portion of the water sampling assembly 1812. In particular, FIG. 20A illustrates the tracer tubing 1872 and injection valve 1876 for releasing the tracer materials 1874 within the well 10, a first laser emitter and photon receiver 2097A that is positioned above the injection valve 1876, and a second laser emitter and photon receiver 2097B that is positioned below the injection valve 1876. The operation of the flow detection assembly 1870 is substantially similar to the operation of the flow detection assembly 1370 illustrated and described in relation to FIG. 15A. Accordingly, the details of such operation will not be repeated herein.

Figure 20B:
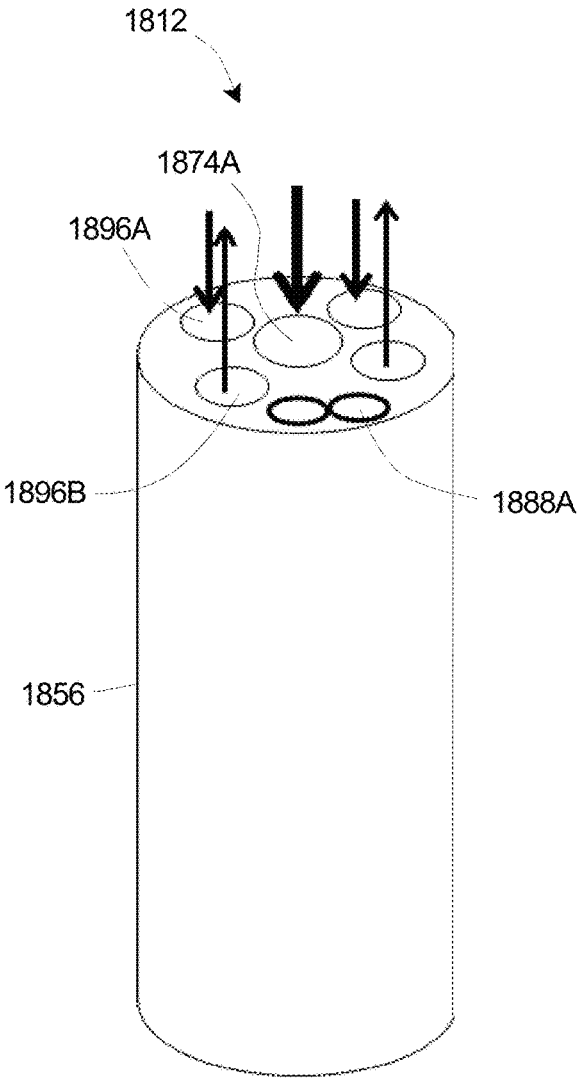
FIG. 20B is a simplified schematic illustration demonstrating another embodiment of the operation of another portion of the water sampling assembly.

FIG. 20B is a simplified schematic illustration demonstrating another example of the operation of another portion of the water sampling assembly 1812. In particular, FIG. 20B illustrates an example of the positioning of the tracer injection tubing 1874A, the fiber optical cables 1896A for transmitting laser beams from the signal processing unit 1832A (illustrated in FIG. 18) to the laser emitters 1897 (illustrated in FIG. 18), the fiber optical cables 1896B for transmitting the fluorescent photon stream from the photon receivers 1897 to the signal processing unit 1832A, and the tubing 1888A of the water sampler 1830 (illustrated in FIG. 18), i.e. the sampling pump 1888 (illustrated in FIG. 18), within the jacket 1856.

It is understood that although a number of different embodiments of the water sampling assembly 12 have been illustrated and described herein, one or more features of any one embodiment can be combined with one or more features of one or more of the other embodiments, provided that such combination satisfies the intent of the present invention.

While a number of exemplary aspects and embodiments of the water sampling assembly 12 have been shown and disclosed herein above, those of skill in the art will recognize certain modifications, permutations, additions and sub-combinations thereof. It is therefore intended that the water sampling assembly shall be interpreted to include all such modifications, permutations, additions and sub-combinations as are within their true spirit and scope, and no limitations are intended to the details of construction or design herein shown.

What is claimed is:

1. A water sampling assembly for sampling water within a groundwater production well, the groundwater production well including a support casing and a well screen that are positioned below a surface, the water sampling assembly comprising:

a primary pump that is positioned within the groundwater production well, the primary pump defining at least a portion of an annulus between the primary pump and one of the support casing and the well screen; and a water sampler that is configured to obtain a plurality of water samples from the groundwater production well without removal of the water sampler from the ground water production well between sampling events and while the primary pump is positioned within the groundwater production well; wherein the water sampler is a multilevel bailer including a plurality of sampling tubes and a plurality of tube valves, with one tube valve being associated with each of the plurality of sampling tubes; and wherein a bottom of one of the plurality of sampling tubes is positioned at a different depth within the groundwater production well than a bottom of one of the other sampling tubes of the plurality of sampling tubes.

2. The water sampling assembly of claim 1 wherein one of the plurality of water samples is obtained with each of the plurality of sampling tubes.

3. The water sampling assembly of claim 2 wherein each of the plurality of water samples is obtained from a different depth within the groundwater production well.

4. The water sampling assembly of claim 1 wherein all of the plurality of sampling tubes are conjoined together within a single jacket so as to form a single sampling unit.

5. A water sampling assembly for sampling water within a groundwater production well, the groundwater production well including a support casing and a well screen that are positioned below a surface, the water sampling assembly comprising:

a primary pump that is positioned within the groundwater production well, the primary pump defining at least a portion of an annulus between the primary pump and one of the support casing and the well screen;

a water sampler that is configured to obtain a plurality of water samples from the groundwater production well without removal of the water sampler from the ground water production well between sampling events and while the primary pump is positioned within the groundwater production well, the water sampler being a multilevel bailer including a plurality of sampling tubes; and a flow detection assembly that is conjoined with the water sampler within a single jacket to form a conjoined system, the flow detection assembly being configured to detect a flow of the water within the groundwater production well;

wherein one of the plurality of sampling tubes includes a bottom that extends away from the jacket within the groundwater production well.

6. The water sampling assembly of claim 5 wherein the plurality of water samples are obtained from multiple depths within the groundwater production well.

7. The water sampling assembly of claim 6 wherein the flow detection assembly is configured to detect the flow of the water within the groundwater production well at each of the multiple depths within the groundwater production well.

8. The water sampling assembly of claim 5 wherein the multilevel bailer further includes a plurality of tube valves, with one tube valve being associated with each of the plurality of sampling tubes.

9. The water sampling assembly of claim 8 wherein one of the plurality of water samples is obtained with each of the plurality of sampling tubes.

10. The water sampling assembly of claim 5 wherein the conjoined system is inserted into the groundwater production well through the annulus.

11. The water sampling assembly of claim 5 wherein the groundwater production well further includes an access pipe that extends below a level of the primary pump, and wherein the conjoined system is inserted into the groundwater production well through the access pipe.

12. The water sampling assembly of claim 5 wherein the flow detection assembly includes a tracer injection tube that retains a tracer material, and an injection valve that regulates injection of the tracer material from the tracer injection tube into the groundwater production well.

13. The water sampling assembly of claim 12 wherein the flow detection assembly further includes a tracer detector that is positioned at a different depth than the injection valve within the groundwater production well, the tracer detector being configured to detect the presence of the tracer material in the water within the groundwater production well.

14. The water sampling assembly of claim 12 wherein the flow detection assembly further includes a first laser emitter that is positioned at a different depth than the injection valve within the groundwater production well to detect a flow of the water within the groundwater production well.

15. The water sampling assembly of claim 14 wherein the first laser emitter is positioned above the tracer injection tube within the groundwater production well.

16. The water sampling assembly of claim 14 wherein the first laser emitter is positioned below the tracer injection tube within the groundwater production well.

17. The water sampling assembly of claim 14 wherein the flow detection assembly further includes a second laser emitter, and wherein the first laser emitter is positioned above the injection valve within the groundwater production well and the second laser emitter is positioned below the injection valve within the groundwater production well.

18. The water sampling assembly of claim 12 wherein the tracer material is injected into the groundwater production well with the primary pump turned on such that the flow detection assembly is configured to detect a dynamic flow of the water within the groundwater production well.

19. The water sampling assembly of claim 12 wherein the tracer material is injected into the groundwater production well with the primary pump turned off such that the flow detection assembly is configured to detect an ambient flow of the water within the groundwater production well.

20. The water sampling assembly of claim 12 wherein the flow detection assembly includes a plurality of tracer injection tubes that each retain the tracer material, each tracer injection tube including a corresponding injection valve that regulates the injection of the tracer material from the tracer injection tube into the groundwater production well.

21. A method for sampling water within a groundwater production well, the groundwater production well including a support casing and a well screen that are positioned below a surface, the method comprising the steps of:

positioning a primary pump within the groundwater production well, the primary pump defining at least a portion of an annulus between the primary pump and one of the support casing and the well screen;

collecting a plurality of water samples from the groundwater production well with a water sampler without removal of the water sampler from the groundwater production well between sampling events and while the primary pump is positioned within the groundwater production well, the water sampler being a multilevel bailer including a plurality of sampling tubes;

conjoining a flow detection assembly with the water sampler within a single jacket to form a conjoined system, wherein one of the plurality of sampling tubes includes a bottom that extends away from the jacket within the groundwater production well; and detecting a flow of the water within the groundwater production well with the flow detection assembly.

22. The method of claim 21 wherein the step of collecting includes collecting the plurality of water samples from multiple depths within the groundwater production well; and wherein the step of detecting includes detecting the flow of the water within the groundwater production well with the flow detection assembly at each of the multiple depths within the groundwater production well.

23. The method of claim 21 wherein the step of collecting includes the multilevel bailer further including a plurality of tube valves, with one tube valve being associated with each of the plurality of sampling tubes; and wherein one of the plurality of water samples is obtained with each of the plurality of sampling tubes.

24. The method of claim 21 wherein the step of detecting includes the steps of retaining a tracer material within a tracer injection tube, and regulating injection of the tracer material from the tracer injection tube into the groundwater production well with an injection valve.

* * * * *